United States Patent [19]

Araki et al.

[11] Patent Number: 4,922,306

[45] Date of Patent: May 1, 1990

[54] COPYING APPARATUS WITH DOCUMENT FEEDER

[75] Inventors: Kazuhiro Araki; Masazumi Ito, both of Osaka, Japan

[73] Assignee: Minolta Camera Kabushiki Kaisha, Osaka, Japan

[21] Appl. No.: 165,016

[22] Filed: Mar. 7, 1988

[30] Foreign Application Priority Data

Mar. 10, 1987 [JP] Japan ..... 62-54395

[51] Int. Cl.[5] ..... G03G 21/00

[52] U.S. Cl. ..... 355/313; 355/318; 355/320; 355/326

[58] Field of Search ..... 355/3 R, 3 SH, 14 SH, 355/23, 24, 313, 318, 319, 320, 326, 327, 244

[56] References Cited

U.S. PATENT DOCUMENTS

| | | | |
|---|---|---|---|
| 3,645,615 | 2/1972 | Spear, Jr. | 355/3 |
| 3,960,445 | 6/1976 | Drawe | 355/319 X |
| 4,017,173 | 4/1977 | Komori et al. | 355/8 |
| 4,291,341 | 9/1981 | Yajima | 358/300 |
| 4,508,447 | 4/1985 | Doery | 355/319 |
| 4,537,497 | 8/1985 | Masuda | 355/14 R |
| 4,699,365 | 10/1987 | Smith et al. | 355/320 X |
| 4,705,393 | 11/1987 | Ito | 355/14 SH |
| 4,743,945 | 5/1988 | Ito et al. | 355/244 |
| 4,750,017 | 6/1988 | Sakai | 355/3 SH X |
| 4,772,917 | 9/1988 | Tani | 355/14 SH |

FOREIGN PATENT DOCUMENTS

| | | |
|---|---|---|
| 61-153667 | 7/1986 | Japan . |
| 62-11865 | 1/1987 | Japan . |

*Primary Examiner*—Fred L. Braun

*Attorney, Agent, or Firm*—Burns, Doane, Swecker & Mathis

[57] ABSTRACT

A copying apparatus includes an exposure section, a document tray which supports stacked documents to be sent to the document support table of the exposure section and a document accommodation section which causes a first document to draw back after completion of the copying operation based on the first document which is sent first from the document tray. A copy sheet having a common image of a first document and different additional images of a plurality of second documents can be obtained. In case a first document tray for the first document and a second document tray for the second document are provided, the first document tray is used to accommodate the first document drawn back during the copying operation based on the second document. When a document tray, which supports a sheet of the first document and plural sheets of the second document under the stacked condition, is provided, a unit is provided to cause a first document, which is sent first to the document support table from the document tray, to be drawn back and then accommodate such first document. In case the first document is a double-sided document, the first document surface is reversed upside down and is sent to the copying position while such first document is sent again to the document support table from the accommodated position in the unit. The image of the first document and the image of the second document can be formed in different colors.

20 Claims, 24 Drawing Sheets

COPYING APPARATUS WITH DOCUMENT FEEDER

BACKGROUND OF THE INVENTION

1. Field of the Invention

The present invention relates to a copying apparatus with an automatic document feeder, and, more particularly, to a copying apparatus having a composite copying function capable of effecting transfer of images in plural number of times onto one side of a single sheet, and a double-side copying function capable of effecting transfer of images onto both the surface and the back.

2. Description of the Prior Arts

A copying apparatus, which has realized transfer of a plurality of images of a plurality of documents to a copy sheet, has recently been developed. For instance, the U.S. Pat. No. 4,537,497 discloses a copying apparatus providing the double-side copying function to conduct the copying to both sides of a copy sheet and the composite copying function to conduct a plurality of copyings to a single side of a copy sheet. For the double-side copying or composite copying operation, a copy sheet, which has been supplied from a cassette to form images thereon through an image forming section and an image fixing section, is sent to an intermediate tray and then sent again therefrom to the image forming section through a transporting section. The copying apparatus of this type provides a transparent table for supporting a book type document and a document tray for supporting a sheet type document and moreover provides a light source to irradiate the book type document through the transparent table and another light source which irradiates the sheet type document transported from the document tray.

The U.S. Pat. No. 4,705,393 provides a document feed unit which is attached to the position of transparent document support table at the upper part of the apparatus body, a document supplying unit which transports a sheet type document to the document feed unit and a reverse unit which accommodates, in the interrupt copying mode, a document transported from the copying position on the document support table. Upon completion of the interrupt copying, the relevant document is automatically transported reversely to the copying position from the accommodating position within the reverse unit to realize the copying based on the document. For the copying of both sides of document, namely, for respective copyings of images recorded to both sides of a sheet type document, after the copying of image on the one side of document, the document is transported to the reverse unit, the document sent from the reverse unit is then placed upside down and transported again to the copying position on the document support table.

SUMMARY OF THE INVENTION

It is a primary object of the present invention to provide a copying apparatus which comprises a first document tray to send a particular sheet type first document and a second document tray to accommodate a plurality of other sheet type second documents and continuously obtains a copied sheet having the common image based on the first document and different images based on the second documents by alternately supplying the first and second documents.

Another object of the present invention is to provide a copying apparatus comprising two document trays, a first document tray which supports a sheet type first document and sends the first document therefrom to the copying position and a second document tray which supports stacked sheet type second documents and sends the second documents therefrom to the coping position.

A further object of the present invention is to provide a copying apparatus comprising a document tray which supports a plurality of stacked sheet type documents and a reverse unit which accommodates a document sent first to the copying position from the document tray and causes it to draw back after the copying of the image thereof to a copy sheet and then sends again the first document from the draw-back position to the copying position after the image of sheet type document sent next from the document tray is copied to the copy sheet on which the first document is copied.

A still further object of the present invention is to provide a copying apparatus comprising a reverse unit which sends the first document from the draw-back position to the copying position with the same side placed against copying position for copying both images of the first document and the second document after the image of the first document sent first to the copying position from the document tray is copied to a copy sheet and the image of the second document sent next to the copying position from the document tray is copied to the same copy sheet.

A still further object of the present invention is to provide a copying apparatus comprising a reverse unit which sends a first document after placing it upside down from the draw-back position to the copying position with the opposite thereof placed against the copying position for copying both images of the first document and the second document after the image of the single side of the first document including images at both sides thereof sent first to the copying position from the document tray is copied to a copy sheet and the image of the second document sent next to the copying position from the document tray is copied to the same copy sheet.

A still further object of the present invention is to provide a copying apparatus comprising an intermediate tray which accommodates the copy sheet after an image of the first document is copied thereon and then sends the same copy sheet again to the image forming section for copying an image of the second document.

A still further object of the present invention is to provide a copying apparatus comprising a paper path which guides a copy sheet on which the image of the first document is copied to the intermediate tray with the copied surface placed downward in the composite copying mode wherein the image of the second document is further copied to the surface where image of the first document is copied and also guides a copy sheet on which the image of the first document is copied to the intermediate tray with the copied image of the first document placed upward in the double-side copying mode where the image of the second document is copied to the surface opposed to the surface where image of the first document is copied.

A still further object of the present invention is to provide a copying apparatus comprising a pair of developing devices for different colors whereby being capable of copying image of the first document in the colors thereof and image of the second document in the colors thereof to the same copy sheet.

In accordance with the present invention there is provided a copying apparatus comprising; a document exposure means for exposing a document, an image forming means for forming an image of a document on a copy sheet, a first document supply means which accommodates a sheet of the first document, transports this first document to the document exposure means, causes the first document to draw back after an image of the first document is formed by the image forming means and accommodates again the first document, a second document supply means which accommodates a plural sheets of the second document, transports this second document to the document exposure means and discharges the second document after an image of the second document is formed by the image forming means, and a control means which controls the first document supply means and the second document supply means in order to alternately send the first document and the second document to the document exposure means.

Further in accordance with the present invention there is provided a copying apparatus comprising; a document exposure means for exposing a document, a first document supply means for supplying the first document to the document exposure means, a second document supply means for supplying the second document to the document exposure means, and an image forming means for forming an image of the first document supplied from the first document supply means to the one surface of a copy sheet and also forming an image of the second document supplied by the second document supply means to the other surface of the copy sheet already forming the image to the one surface.

Further in accordance with the present invention there is provided a copying apparatus comprising; a document exposure means for exposing a document, a first document supply means for supplying the first document to the document exposure means, a second document supply means for supplying the second document to the document exposure means, and an image forming means for forming an image of the first document supplied from the first document supply means and an image of the second document supplied by the second document supply means on the same surface of copy sheet.

And in accordance with the present invention there is provided a copying apparatus comprising; a document exposure means for exposing a document, an exposure frequency input means for inputting a number of times of exposure to the document, a document supply means for accommodating a plurality of documents and for supplying documents sheet by sheet to the document exposure means, a document discharge means for discharging the document from the exposure means to a document receive portion after the input number of times of exposure have been completed, a document re-supply means for once accommodating the document exposed by the exposure means in such a frequency as being input, supplying the document again to the document exposure mean in the predetermined timing, and accommodating again the document after the exposure to the document in such a frequency as being input, a first control means for controlling the document re-supply means in order to accommodate a document, which has been sent first to the document exposure means by the document supply means and completed the exposure in the input frequency, to the document re-supply means, a second control means for controlling the document discharge means in order to discharge a document, which has been sent second or successively to the document exposure means by the document supply means and has completed the exposure in the input frequency, to the document receive section, a third control means for operating the document re-supply means for each completion of exposure to the second or successive document in the input frequency, and a fourth control means for operating the document supply means for each completion of exposure in the input frequency to the document supplied to the document exposure means by the document supply means.

And in accordance with the present invention there is provided a copying apparatus comprising; a document exposure means for exposing a document, an image forming means for forming an image of exposed document on a copy sheet, a document supply means for accommodating in a plurality of documents, supplying the documents sheet by sheet to the document exposure means and discharging the document exposed from the document exposure means, a document re-supply means for reversing and sending again the discharged document in a double-side document mode, and for once accommodating the discharged document, and then sending again the document to the document exposure means in the predetermined timing in a special copying mode, a double-side mode selection means for selectting the double-side document mode, a special mode selection means for selecting the special mode, and a means for releasing the double-side document mode in response to the selection of special mode by the special mode selection means.

Further in accordance with the present invention there is provided a copying apparatus comprising; a document exposure means for exposing a document, an image forming means for excuting single copying operation to the same copy sheet and in a first copying mode and for excuting several copying operations to the same copy sheet, a document supply means for accommodating a plurality of documents, supplying the documents sheet by sheet to the document exposure means and discharging the documents exposed from the document exposure means, a document re-supply means for reversing upside down the document discharged from the document exposure means and sending the document again to the document exposure means in a first transportation mode and for once accommodating the document discharged from the document exposure means and then sending again the document to the document exposure means in the predetermined timing in a second transportation mode, a transportation mode selection means for selectively setting the first transportation mode and the second tranportation mode, and means for selecting the second copying mode responding to selection of the second tranportation mode by the tranportation mode selection means.

DESCRIPTION OF THE PREFERRED EMBODIMENT

Figure 1:
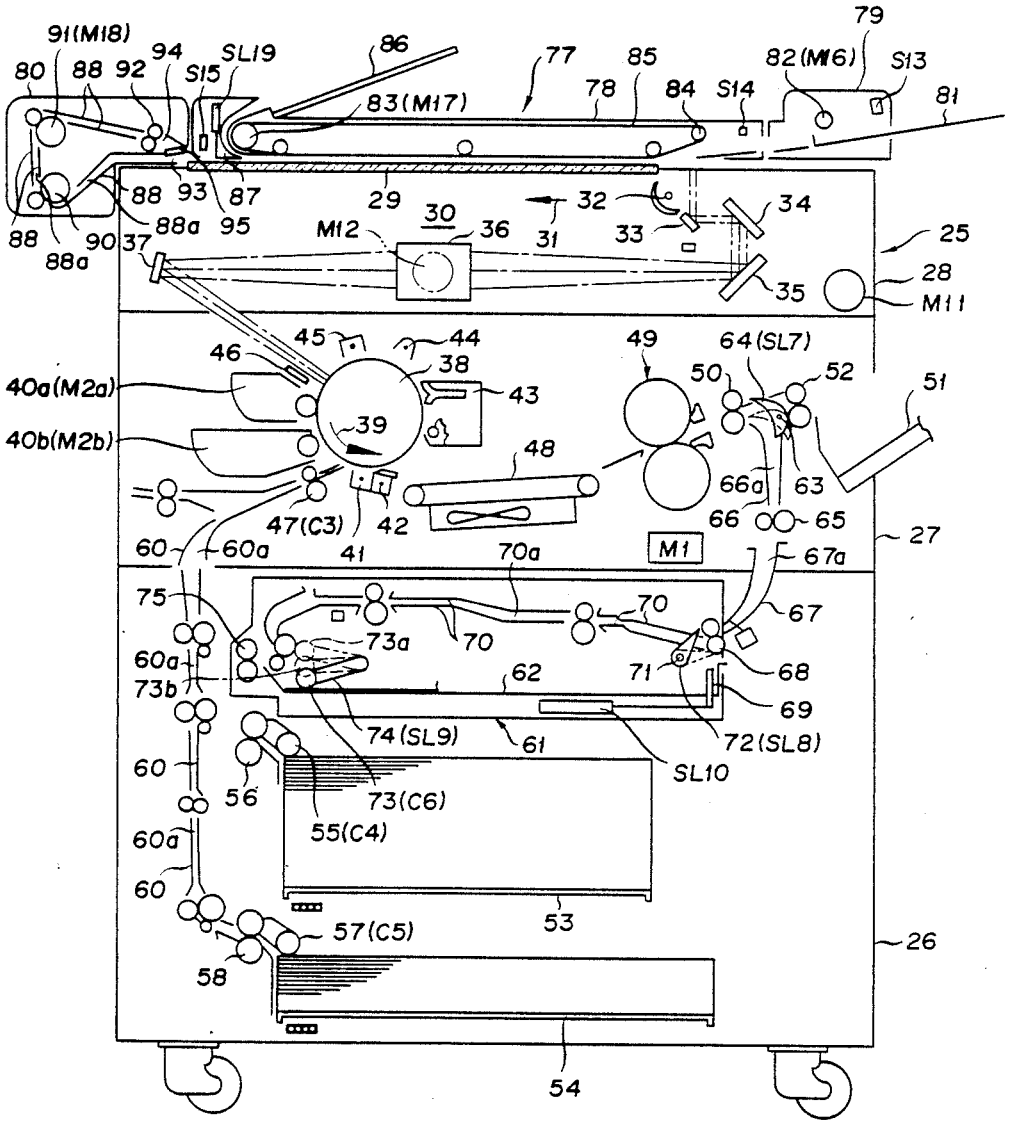
FIG. 1 is a sectional view of a copying apparatus with automatic document feeder to which the present invention is applied.

FIG. 1 shows outline of a copying apparatus of the present invention. This outlined structure of copying apparatus is almost similar to that disclosed in the U.S. Ser. No. 883,144 filed on July 8, 1986, now U.S. Pat. No. 4,743,945. The apparatus body 25 comprises a sheet supply section 26 located at the lowest part, an image forming section 27 which is located on such sheet supply section and forms an image of document for a copy sheet sent from the sheet supply section and an image forming optical system section or document exposure section 28 which is located on such image forming section and forms an electrostatic latent image of a document on a photosensitive medium provided within the image forming section 27.

A transparent document support table 29 which supports documents is provided at the upper part of the optical system section 28 and an image forming optical system 30, which is built in the section 28 and scans the document in the direction of arrow mark 31, is well known and comprises a light source 32, movable mirrors 33, 34, 35, a focusing lens 36 and a fixed mirror 37.

In such image forming section 27, a photosensitive drum 38 on which an electrostatic latent image is formed corresponding to the image of document through the image forming optical system 30 is provided rotatably in the direction of arrow mark 39. Moreover, in such image forming section 27, a pair of magnetic brush type developing devices 40*a*, 40*b* are provided adjacent to the photosensitive drum 38 for adhering the formed electrostatic latent image with toner. The one developing device 40*a* adheres the latent image with the toner in red, while the other developing device 40*b* with the toner in black. A transfer charger 41 for transferring toner to the copy sheet and a separating charger 42 for separating the copy sheet from the photosensitive drum 38 are provided at the lower position of the photosensitive drum 38 within the image forming section 27. For removing the toner remaining on the outer peripheral surface of the photosensitive drum 38 after transfer of toner to the copy sheet. a cleaner 43 is provided adjacent to the photosensitive drum 38. Moreover, an eraser 44 which removes residual charge on the outer peripheral surface of photosensitive drum 38 for the successive copyings and a corona charger 45 which uniformly charges the outer peripheral surface of photosensitive drum 38 before formation of an electrostatic latent image thereto are provided in the image forming section 27. For erasing the charges of the unnecessary part of the electrostatic latent image formed on the photosensitive drum 38, namely the part to be edited, for example, by the trimming, etc., an eraser 46 for edition is also provided within the image forming section 27.

On the occasion of forming an electrostatic latent image to the outer peripheral surface of the photosensitive drum 38, this photosensitive drum 38 is rotated at a constant velocity V in the direction indicated by the arrow mark 39, the light source 32 and the movable mirror 33 are moved together at the velocity of V/m in the direction indicated by the arrow mark 31, and other two mirrors 34 and 35 are also moved together at the velocity of V/2 m in the direction indicated by the arrow mark 31. Here, m is copying magnification.

In order to transfer a copy sheet between the photosensitive drum 38 and the transfer, charger 41 on the occasion of transferring the, toner developed to the latent image formed on the drum 38 to the copy sheet, a timing roller 47 is arranged in the image forming section 27. Therefore, a copy sheet is once stopped by this timing roller 47 and then sent between the photosensitive drum 38 and transfer charger 41 by the roller 47 in the velocity synchronized with the circumferential speed of the photosensitive drum 38. The toner image of photosensitive drum 38 is transferred by discharge of transfer charger 41, the copy sheet separated from the drum 38 by discharge of separating charger 42 is transported by a transportation belt 48 having a suction pump while it is attracted to the surface thereof to a fixing device 49 provided in the down-stream side of this transportation belt 48.

In the down-stream side of the fixing device, a pair of transportation rollers 50 are provided and a pair of discharge rollers 52 are also provided with predetermined interval from a pair of transportation rollers 50 to supply the copy paper after completion of the copying operation to a sheet discharge tray 51 attached to the end portion of the image forming section 27.

A pair of sheet supply cassettes, the first and second cassettes 53, 54 are built in the sheet supply section 26 in order to store the copy sheets in different sizes. A sheet supply roller 55 which is to be in contact with the upper most copy sheet in the first sheet supply cassette 53 and a pair of rollers 56 located in the down-stream side of such roller are arranged within the sheet supply section 26 in order to transfer the upper most copy sheet in the first sheet supply cassette 53 at the upper side, and moreover a sheet supply roller 57 to be in contact with the upper most copy sheet in the second sheet supply cassette 54 and a pair of rollers 58 located in the downstream side of such roller are arranged in the sheet supply section 26 in order to transfer the upper most copy sheet in the second sheet supply cassette 54 in the lower side. A plurality of guide plates 60 are provided in the region extended to the image forming section 27 from the sheet supply section 26 in order to guide the copy sheets stored in these sheet supply cassettes 53, 54 to the timing roller 47 and a paper path 60*a* is formed by these guide plates 60. Accordingly, the copy sheets in the sheet supply cassette 53 are transported to the timing roller 47 passing through the path 60*a* and the copy sheets in the sheet supply cassette 54 are transported to the timing roller 47 through the paper path 60*a* by selectively driving these sheet supply roller 57 and a pair of rollers 58 for the sheet supply roller 55 and a pair of rollers 56.

In the case of the composite copying operation wherein the second copying operation is carried out to a copy sheet after the first copying operation is carried out to such copy sheet within the sheet supply cassettes 53, 54 to realize the second formation of an image to the same surface where an image is formed by the first copying operation or in the case of the double-side copying operation where an image is formed by the second copying operation to the surface opposed to the surface where an image is formed by the first copying operation, the copy sheet which has completed the first copying operation is not discharged to the outside and is supplied again to the image forming section. Therefore, the intermediate tray unit 61 which accommodates the copy sheets after completion of the first copying operation is arranged at the upper part of the sheet supply cassette 53 within the sheet supply section 26.

A changeover lever 64 which is freely rotated by a shaft 63 and rotated between the position indicated by a solid line and the position indicated by a phantom line in FIG. 1 is provided between a pair of transportation rollers 50 and a pair of discharge rollers 52 in order to guide the copy sheets which have completed the first copying operation to the intermediate tray 62 provided in the intermediate tray unit 61 and the guide plates 66 which form the paper path 66*a* are provided between a pair of transportation rollers 65 and the changeover lever 64 attached under the changeover lever 64. In addition, the guide plates 67 which form the paper path 67*a* are provided to supply the copy sheets which have completed the first copying operation and passed a pair of transportation rollers 65 to the intermediate tray unit 61 are provided between a pair of transportation rollers 65 and the intermediate tray unit 61.

At the entrance of intermediate tray unit 61, a pair of transportation rollers 68 are provided to send the copy sheets having passed the paper path 67*a* in the guide plates 67 to the intermediate unit 61. A guide plates 70 which form the paper path 70*a* for reversing the copy sheet are provided within the intermediate tray unit 61 for reversely sending the copy sheet having passed a pair of transportation rollers 68 to the intermediate tray 62. For the second copying operation to the copy sheet which has completed the first copying operation, the copy sheet which has completed the first copying operation is guided to the lower side of the changeover lever 64 and is then sent to the transportation roller pair 68 through the paper paths 66*a*, 67*a*. For the double-side copying mode to carry out the copying operation to the other surface of the copy sheet that the surface where the first copying operation is completed, the copy sheet is guided through the paper path 70*a* in the guide plates 70 and is then accommodated in the intermediate tray 62 with the surface completing the first copying operation placed upward. Thereby, the copy sheet which has passed the paper path 60*a* from the intermediate tray 62 is transported between the photosensitive drum 38 and transfer charger 41 with the uncopied surface placed upward. Moreover, for the composite copying mode where the second copying operation is carried out to the same surface of copy sheet as having completed the first copying operation, the copy sheet having passed the transportation roller pair 68 is then accommodated in the intermediate tray 62 with the attitude unchanged. Thereby, the copy sheet is accommodated in the intermediate, tray 62 with the surface having completed the first copying operation placed downward and the copy sheet is then transported therefrom between the photosensitive drum 38 and the transfer charger 41 passing through the paper path 60*a* with the surface having completed the first copying operation placed upward. Since the copy sheet having completed the first copying operation must be guided to the intermediate tray 62 under such necessary condition, a changeover lever 72, which is located in the down-stream side of the transportation roller pair 68, is rotatable around the shaft 71 and also rotates between the position extruding into the paper path 70*a* formed by the guide plates 70 indicated by a solid line in FIG. 1 and the position being far from the paper path 70*a* indicated by a phantom line, is provided within the intermediate tray 61. Thereby, when the changeover lever 72 is set to the position indicated by the phantom line, the copy sheet having passed the transportation roller pair 68 passes the paper path 70*a* and is then accommodated in the intermediate tray 62 after changing the attitude, namely with the upside down. When the changeover lever 68 is set to the position indicated by the phantom line, it is directly transported to the intermediate tray 62 with the attitude unchanged.

For carrying out the second copying operation to the copy sheet which has completed the first copying operation accommodated in the intermediate tray 62, a lever 74 providing a copy sheet resupply roller 73 at the end part thereof is swayably provided within the intermediate tray unit 61 and moreover the roller pair 75 is also provided in the intermediate tray unit 61, in order to transport the copy sheet to the timing roller 47. The copy sheet resupply roller 73 is moved by the lever 74 to the position indicated by the phantom line 73*a* for sending the copy sheet,sent by the roller pair 68, to the intermediate tray 62 through the paper path 70*a* formed by the guide plates 70, or moved to the position indicated by the phantom line 73*b* for sending the copy sheet,sent by the roller pair 68, to the intermediate tray 62 in direct. For the resupply of copy sheet accommodated in the intermediate tray 62, the copy sheet resupply roller 73 is moved by the lever 74 to the position indicated by a solid line and is then placed in contact with the copy sheet with an adequate pressure.

An automatic document feeder with reverse unit (hereinafter referred to as ADFR) 77 is provided on the copying apparatus body 25 and comprises a transportation unit 78 located on the transparent document support table 29, a document supplying unit 79 located in adjacent to the one end such transportation unit and a reverse unit 80 located at the other end part of transportation unit. The document supplying unit 79 is provided with an original document tray 81 which supports the stacked sheet type documents, a sensor S13 which detects existence of document on such document tray 81 and a transportation roller 82 which transports the documents.

Since a transportation belt 85 is extended over a driving roller 83 and a following roller 84 provided in the transportation unit 78, a sheet type document, sent to the transportation unit 78 by the transportation roller 82 from the original document tray 81, is further transported to the predetermined copying position on the document supporting table 29 by the transportation belt 85. In order to detect the condition that the document is sent into the transportation unit 78, a sensor S14 is provided to the part adjacent to the document supplying unit 79 within the transportation unit 78. At the upper side of transportation unit 78, a document discharge tray 86 is provided and the document having completed the copying operation is transferred by the transportation belt 85 to the document discharge tray 86. For the transfer of document completing the copying operation into the reverse unit 80 in place of the document exhaust tray 86, a changeover pawl 87 is provided with the transportation unit 78 adjacent to the driving roller 83 in the reverse unit 80. This changeover pawl 87 is moved, by a solenoid SL19, to the position adjacent to the document supporting table 29 and the position apart therefrom. In addition, a sensor S15 is provided adjacent to the changeover pawl 87 in the transportation unit 78 in order to detect the document to be sent to the reverse unit 80 from the transportation unit 78.

In the reverse unit 80, a plurality of guide plates 88 are provided for accommodating and causing the document sent by the transportation belt 85 of transportation unit 78 to draw back while it is bent and three pairs of rollers 90, 91, 92 are also provided to move the document within the document draw-back space 88*a* formed by the guide plates 88. An opening 93 for entrance and exit 93 connected to the transportation unit 78 and the draw-back space 88*a* is formed to the part adjacent to the transportation unit 78 in the reverse unit 80 and an opening 94 for exit connected to the draw-back space 88*a* is formed to the part adjacent thereto. A cover member 95, which usually closes the opening 94 for exit and is opened by the document sent to the transportation unit 78 from the opening 94 for exit, is provided between the opening 93 for entrance and exit and the opening 94 for exit.

Next, special copying operation attained by the copying apparatus of the present invention is explained with reference to FIG. 2 and FIG. 3.

Figure 2:
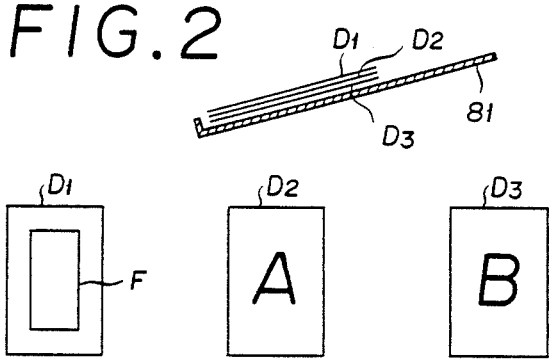
FIG. 2 is a diagram for showing a document under the special copying operations attained by the copying apparatus of the present invention.

FIG. 2 shows the condition where three sheets of documents D1 to D3, for example, are accommodated on the original document tray 81. Here,it is assumed that an image, namely a quadrilateral figure indicated by F, for example, is recorded on the upper most document, namely the first document D1, a letter image "A" is recorded on the next lower document, namely the second document D2 and another letter picture "B" is recorded on the lower most document, namely another second document D3. Respective documents D1 to D3 are supported by the original document tray 81 with the recorded images placed downward.

Figure 3A:
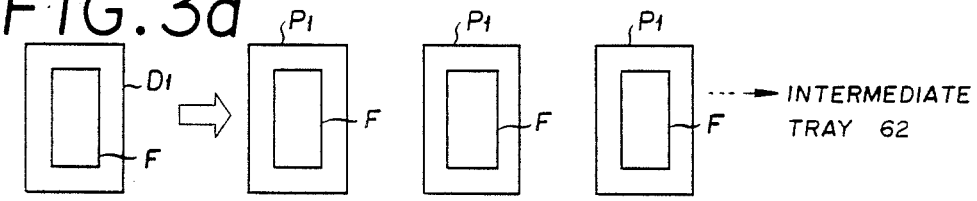
FIG. 3*a* to FIG. 3*d* are diagrams for showing special copying processes of the present invention attained the document shown in FIG. 2.
Figure 3B:
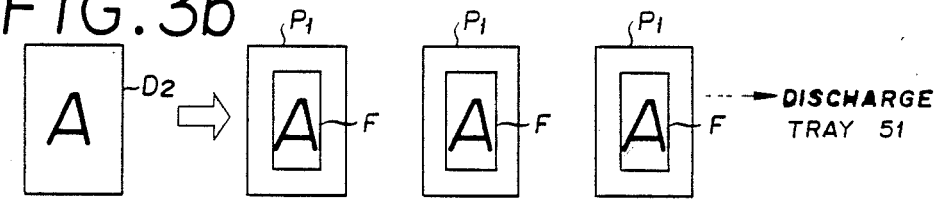
Figure 3C:
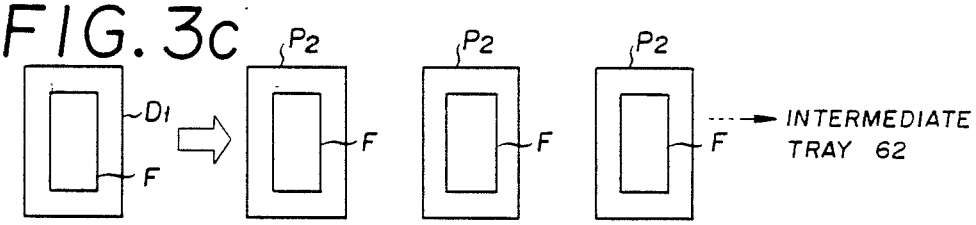
Figure 3D:
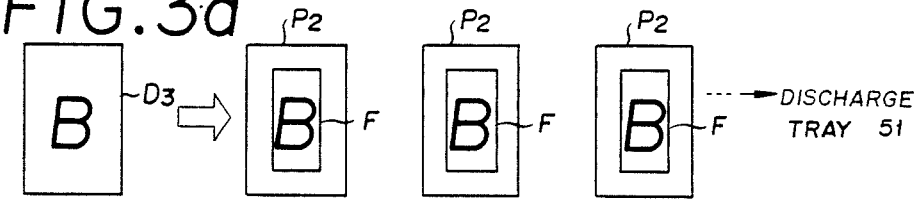

In the copying apparatus of the present invention, a common graphic image or picture F of the first document D1 having the common graphic image F is combined with an image of the second document D2 recording a picture or an image "A" as indicated in FIG. 3*b* and thereby the copy sheets P1 in the predetermined number of sheets can be obtained and moreover, as indicated in FIG. 3*d*, the common image F recorded on the first document D1 is combined with the image "B" recorded on the other second document D3 and thereby the copy sheets P2 can be obtained. For obtaining two kinds of copy sheets, the copy sheet Pl having the additional image "A" to the common image F and the copy sheet P2 having the additional image "B" to the common image F, the copying operation is started under the condition that the documents D1 to D3 are housed on the original document tray 81 as indicated in FIG. 2. The upper most document D1, which is the first document, is transported to the transportation unit 78 from the document supplying unit 79 by the transportation roller 82 and thereafter it is then transported to the predetermined copying position on the document supporting table 29 by the transportation belt 85 of the transportation unit 78. Under this condition, the copy paper P1 in the one sheet suppy cassette 53 or 54 is sent to the timing roller 47 through the paper pagh 60*a* and the graphic image F recorded in the document D1 is copied to the copy sheet P1 in the image forming section as indicated in FIG. 3*a*. For instance, in FIGS. 3*a* and 3*b*, the common graphic image F of the first document D1 is copied to the copy sheet P1.

The first document D1 which has completed copying of the image F to the copy sheet P1, for example, of three sheets is sent into the reverse unit 80 from the opening 93 for entrance and exit by the transportation belt 85 and is fed back to the paper draw-back space 88*a* formed by the guide plates 88. In the paper draw-back space 88*a*, the first document D1 is moved by the roller pairs 90, 91, 92 and is then drawn back to the predetermined position. In this case, the changeover pawl 87 is separated from the transparent document support table 29 by the operation of solenoid SL18 and allows draw-back of the first document D1 into the reverse unit 80. On the other hand, the copy sheets P1 of the specified number of sheets on which the image F is copied are not transferred to the discharge tray 51 but accommodated on the intermediate tray 62 in the intermediate tray unit 61 passing through the paper path 66*a* between guide plates 66 and the paper path 67*a* between the guide plates 67.

Next, the second document D2 accommodated on the document tray 81 is transported to the specified copying position as explained above and the copy sheet P1 accommodated in the intermediate tray 62 is transported to the image forming section passing through the paper path 60*a*. Thereby, as indicated in FIG. 3*b*, the image "A" recorded on the second document D2 is additionally copied to the copy sheet P1 to which the image F recorded on the first document is copied. The copy sheet P1 combining the image F and image "A" is sent to the discharge tray 51 and the second document D2 is sent to the document discharge tray 86 by the transportation belt 85. In this case, the changeover pawl 87 is caused to proceed toward the transparent document support table 29 by the solenoid SL19.

After the second document D2 is discharged, the first document Dl which has been drawn back into the reverse unit 80 drawn back again to the copying position on the transparent document support table 29 from the opening 93 for entrance and exit by the driving of the roller pairs 90, 91, 92 and the driving of the transportation belt 85. Thereafter, the copy sheet P2 is transported as explained above to the image forming section from any one of the sheet supply cassettes 53 and 54. Thereby, as indicated in FIG. 3*c*, the common image F recorded on the first document D1 is also copied to the other copy sheet P2 as in the case of copy sheet P1. The copy sheet P2 to which the image F is copied is sent to the inetermediate tray 62 as mentioned previously and the first document D1 is sent to the reverse unit 80 and is then drawn back therein.

As explained previously, the copy sheet P2 which has completed copying of the common image F of the first document and is accommodated in the intermediate tray 62 is sent again to the image forming section and the other second document D3 is transported to the specified copying position on the transparent document support table 29 from the document tray 81. Thereby, the composite image of the common image F of the first document D1 and the image "B" recorded on the other second document D3 can be copied to the specified number of copy sheets P2. Thereby, the composite image can be copied to the respective copy sheets P1 and P2.

FIG. 2 and FIG. 3*a* to FIG. 3*d* indicate the concept of an example of the copying operations of the copying apparatus of the present invention. Moreover, it is also possible to copy the common image F of the first document to the one side of copy sheet P1 and the image "A" of the second document to the other side thereof, and to copy the common image F of the first document to the one side of copy sheet P2 and the image "B" of the second document to the other side thereof. In this case, the double-side copyings are carried out to both copy sheets P1 and P2.

The copying operation by the present invention is also possible in case the first document D1 has not only the common image F on the one surface but also the common image F on both sides as explained previously. In this case, it is also possible to send the first document D1 which has been drawn back into the reverse unit 80 after the copying operation to the transportation unit 78 by opening the cover member 95 from the opening 94 for exist on the occasion of sending it again to the copying position and realize copying of the image at the reverse side thereof.

As indicated in FIG. 1, the copying apparatus of the present invention provides a pair of developing devices 40*a* and 40*b* providing the toners indifferent colors. Therefore, the image F recorded on the first document D1 can be copied, for example, in red to the copy sheets P1, P2 using the developing device 40*a* and the images "A", "B" recorded on the second documents D2, D3 can be copied in black to the copy sheets P1, P2 using the developing device 40*b*.

In addition to such special copying operation, the copying apparatus of the present invention realizes, of course, the ordinary copying operation, for instance, that images recorded only on the single side of a document supported by the original document tray 81 are copied only to the single side of a copy sheet accommocated in the only one tray of a pair of sheet supply trays 53 and 54.

Figure 4:
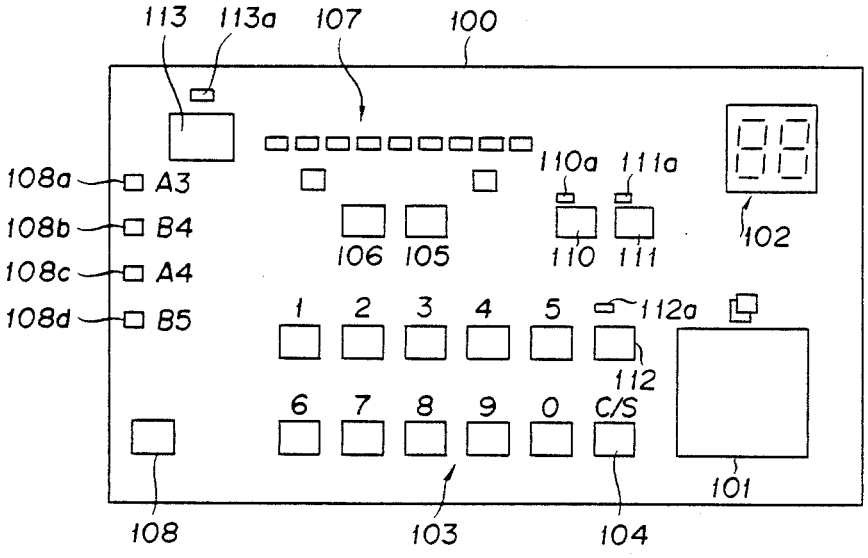
FIG. 4 is a plan view of a control panel of the present invention.

FIG. 4 shows a control panel 100 on which control keys are arranged for operating the copying apparatus. The control panel 100 comprises a print key 101 for starting the copying operation, a copy count display 102 which displays a number of copies with two digits, a ten key cluster 103 with indication of numerals, "1", "2", . . . "0", a clear/stop key 104 which stops the copying operation and clears numeral memory of display 102, up/down keys 105, 106 for setting step by step the toner densities of copied images, an LED density display 107, and a select key 108 for setting a copy sheet size. The preset size of copy sheet is displayed by the paper size LED displays 108*a* to 108*d*.

The control panel 100 is further provided with a mode kay 110 for setting the double-side copying mode and an LED desplay 110*a*, a mode key 111 for setting the composite copying mode and an LED display 111*a*, a mode key 112 for setting the draw-back mode and an LED display 112*a* and a mode key 113 for setting the double-side document mode and an LED display 113*a*.

Figure 5:
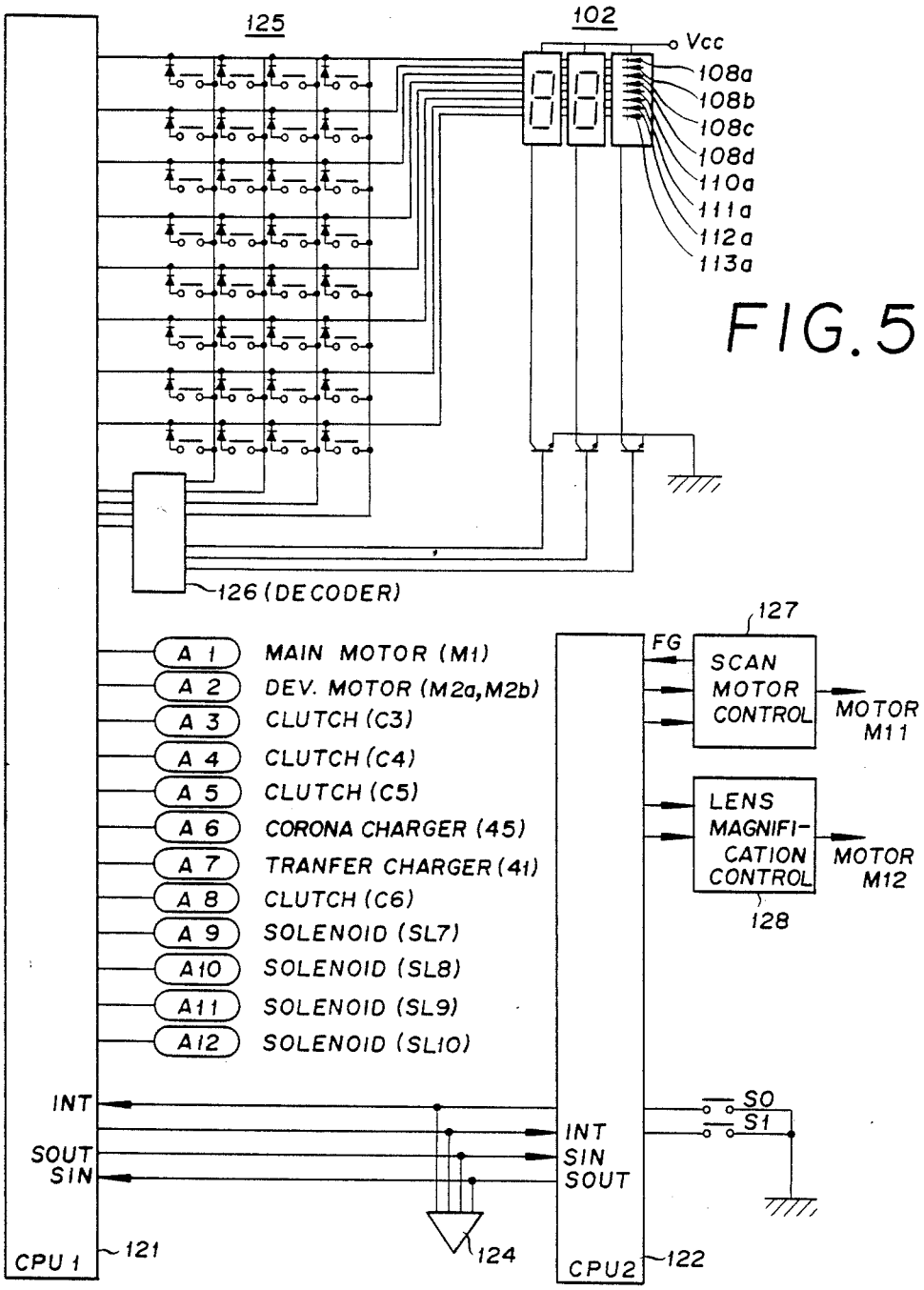
FIG. 5 is a circuit diagram of a master CPU (central processing unit) for controlling elements built in the copying apparatus body.

FIG. 5 is a control circuit of the copying apparatus of the present invention, which comprises a first CPU 121 for mainly controlling respective elements in the image forming section 27 and copy sheet supply section 26 and a second CPU 122 which is connected by the interrupt terminal INT and data input and output terminals Sin, Sout for the first CPU 121 and controls the optical system 30.

Figure 6:
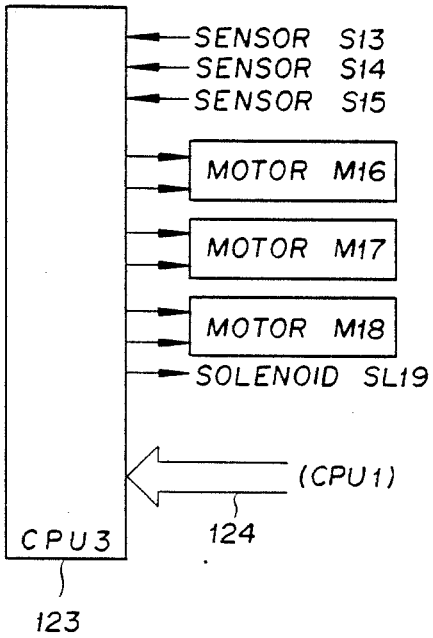
FIG. 6 is a circuit diagram of CPU for controlling an automatic document feeder of the copying apparatus.

FIG. 6 shows a third CPU 123 for controlling the automatic document feeder 77 which is connected to the CPU 121 by a bus 124.

The first CPU 121 is connected with the keys forming the ten-key cluster 103, a switch matrix 125 which operates with the keys 104 to 106, 108 and 110 to 113 and a decoder 126, and signals are sent to the display 102, LED's 108*a* to 108*d*, 110*a*, 111*a*, 112*a* and 113*a* through such elements. The first CPU 121 is further connected with the output terminals A1 to A12 through transistor (not illustrated). These elements operate a main motor M1, a motor M2*a* for operating a developing device 40*a*, a motor M2*b* for operating a developing device 40*b*, a clutch C3 for operating the timing roller 47, a clutch C4 for operating the upper copy sheet supply roller 55, a clutch C5 for operating the lower copy sheet supply roller 57, the corona charger 45, the transfer charger 41, a clutch C6 for operating the copy sheet re-supply roller 73, a solenoid SL7 for operating the changeover lever 64, a solenoid SL8 for operating the changeover lever 72, a solenoid SL9 for operating the lever 74 in the vertical direction and a matching solenoid SL10 for operating the guide plate 68 on the occasion of positioning the copy sheet having completed the copying operation sent to the intermediate tray 62 to the predetermined position.

The second CPU 122 is connected with a scan motor control 127 for sending a control signal to the motor M11 for document scan by the optical system 30 and a lens control 128 for variable magnification to send a signal to the motor M12 for driving a focusing lens 36.

The third CPU 123 shown in FIG. 6 is connected with the sensor S13, sensor S14, sensor S15, motor M16 for driving transportation roller 82, motor M17 for driving the transportation belt 85 through the driving side roller 83, motor M18 for respectively driving the roller pairs 90 to 92 and solenoid SL19.

The copying operations carried out by the CPU's 121, 122 and 123 are explained with reference to the flowcharts explained hereunder.

Figure 7:
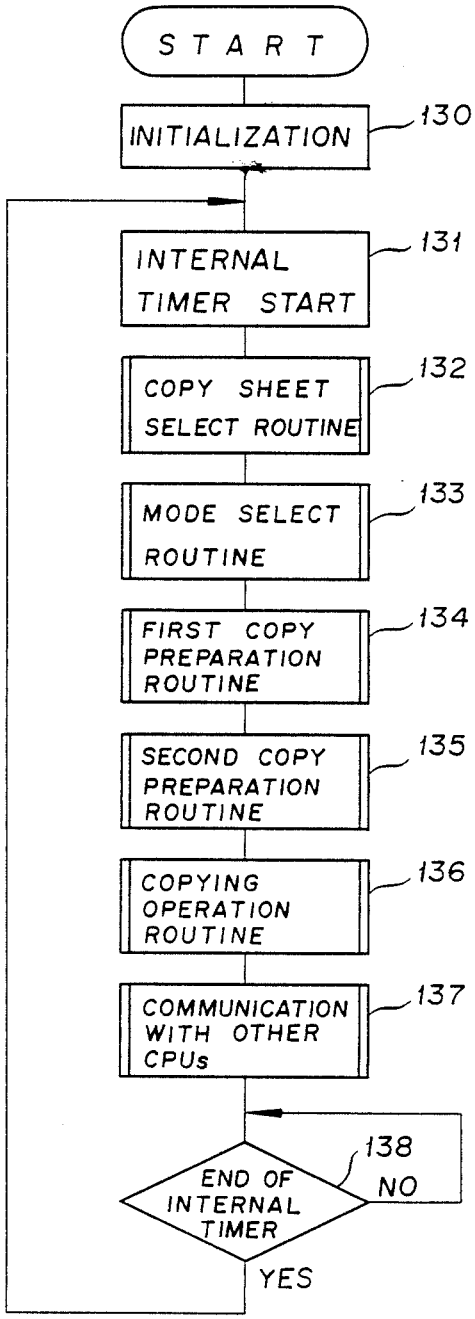
FIG. 7 is a flowchart showing control process attained by the master CPU.

FIG. 7 shows a flowchart of successive steps of control operation of the CPU 121.

When the CPU 121 is reset to start the program, the CPU 121 is initialized. Namely, the content of RAM is erased and various registers are set and such initialization causes the copying apparatus of the present invention to be set to an initial mode (step 130). Subsequently, an internal timer, provided within the CPU 121 and set to the initial value, starts at the step 131. Thereafter, the subroutines 132 to 137 explained hereunder according to the flowchart are called and after all subroutine processes are completed, a routine ends upon termination of internal timer at the step 138 in order to set again such internal timer. The length of one routine is determined for various timers appearing in the subroutines to count. (These various timers determine the completion of count by counting a number of this one routine).

Moreover, the CPU 121 sends data items to other CPUs 122, 123, when called from subroutines.

Prior to explanation of flowcharts, ON-edge is defined as the condition when the switch, sensor or signal changes to ON from OFF state. In addition, OFF-edge is defined as the condition when the switch, sensor or signal changes to OFF from ON state.

Figure 8:
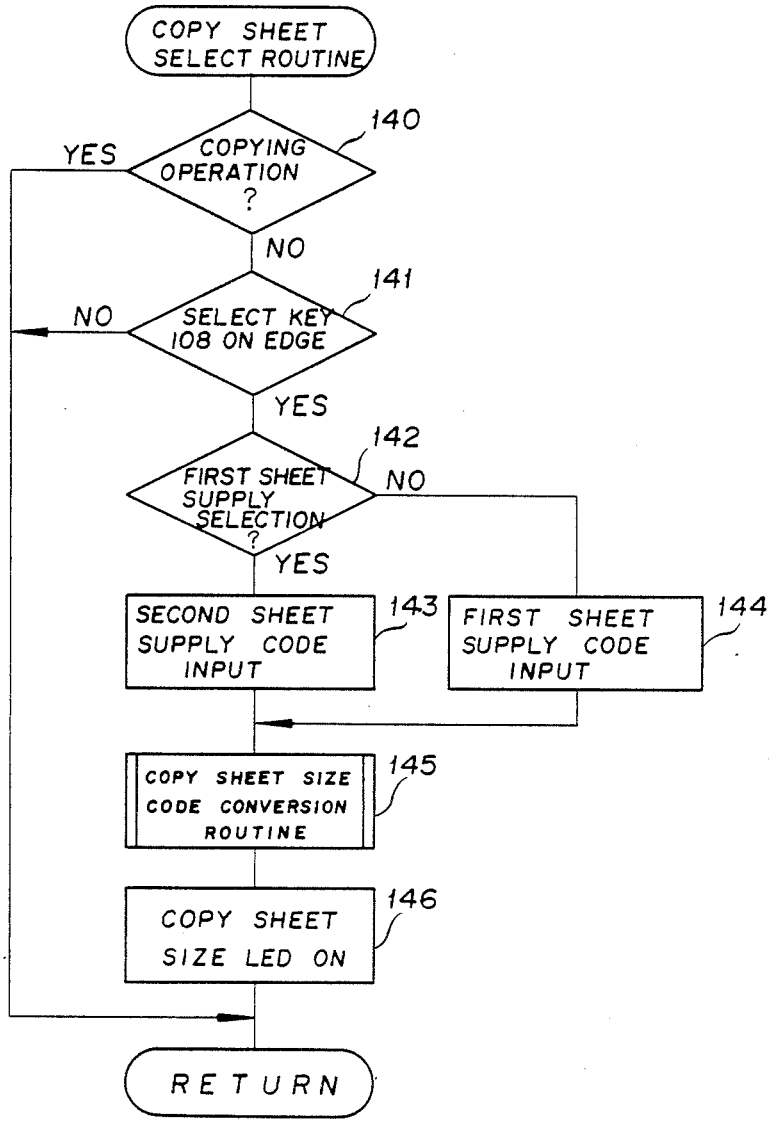
FIG. 8 is a flowchart showing the process of paper size select routine.

FIG. 8 is a flowchart indicating details of step 132 in FIG. 7, as the paper size select routine for selecting a size of copy sheet in accordance with an input from the select key 108 indicated in FIG. 4. Whether the copying operation is carried out or not is first decided in the step 140. When it is decided in the step 140 that the copying operation is not carried out in the apparatus, the select key 108 is turned ON in the step 141 and moreover it is decided in the step 142 that a copy sheet of the first cassette 53 is already selected in the preceding copying operation, a sheet supply code is input to suuply the copy sheet from the second cassette 54 in the step 143, in view of sending the copy sheets in the second cassette 54. When it is decided in the step 142 that selection is already made in the preceding copying operation that the copy sheet is supplied from the second cassette 54, namely when NO is decided in this step, a code for supplying the copy sheet in the first cassette 53 is input in the step 144 in order to send the copy sheet in the first cassette 53. After the signals sent from the steps 143, 144 are converted to the size code of copy sheet, predetermined copy size is displayed in the step 146 with any one of four LED's 108*a* to 108*d* shown in FIG. 4. Thereby, a copy sheet in any one of the two cassettes 53, 54 is set for transfer in comparison with the paper size selected in the preceding copying operation by operating only one select key 108 shown in FIG. 4.

Figure 9A:
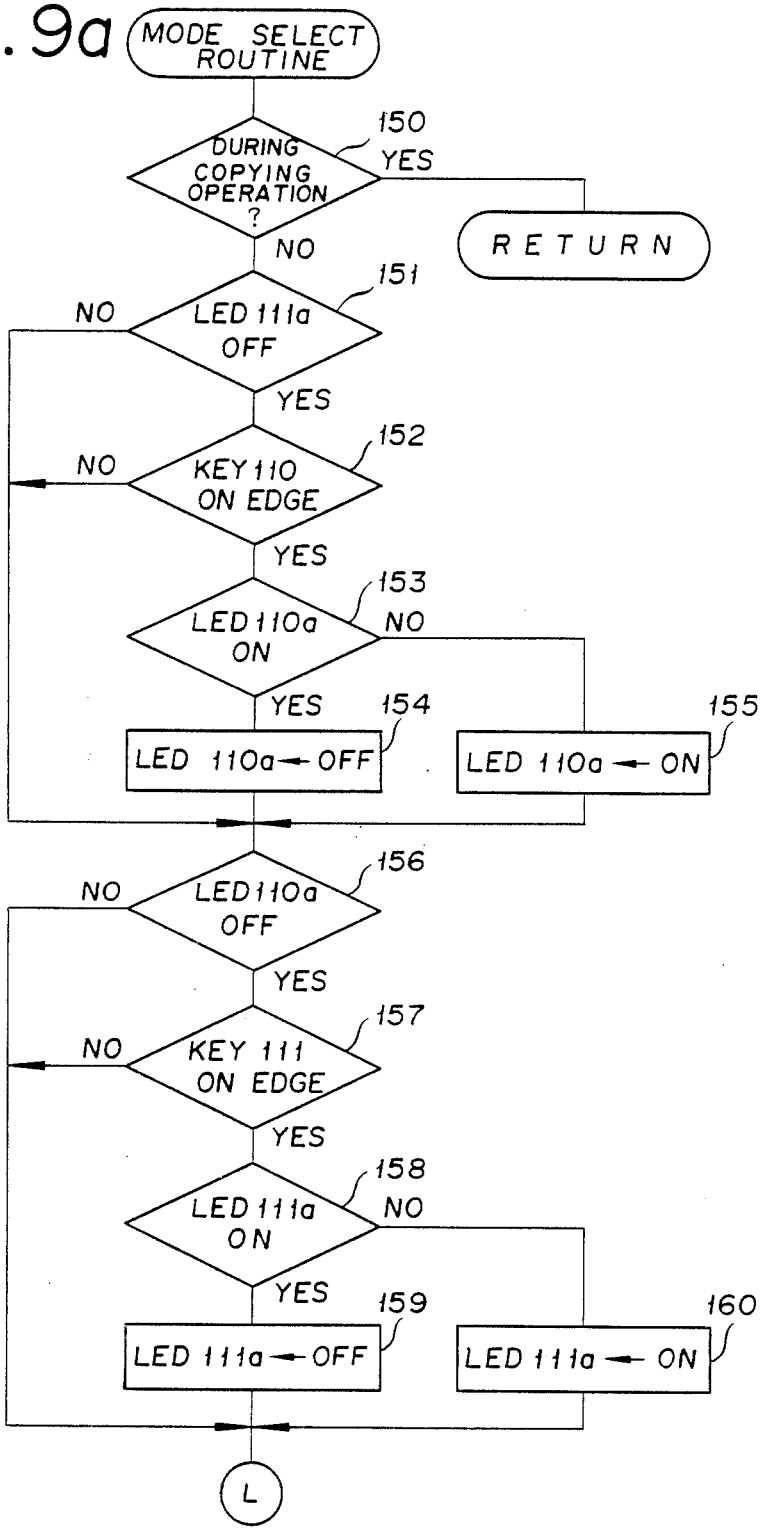
FIG. 9*a* and FIG. 9*b* are flowcharts showing process of mode select routine.
Figure 9B:
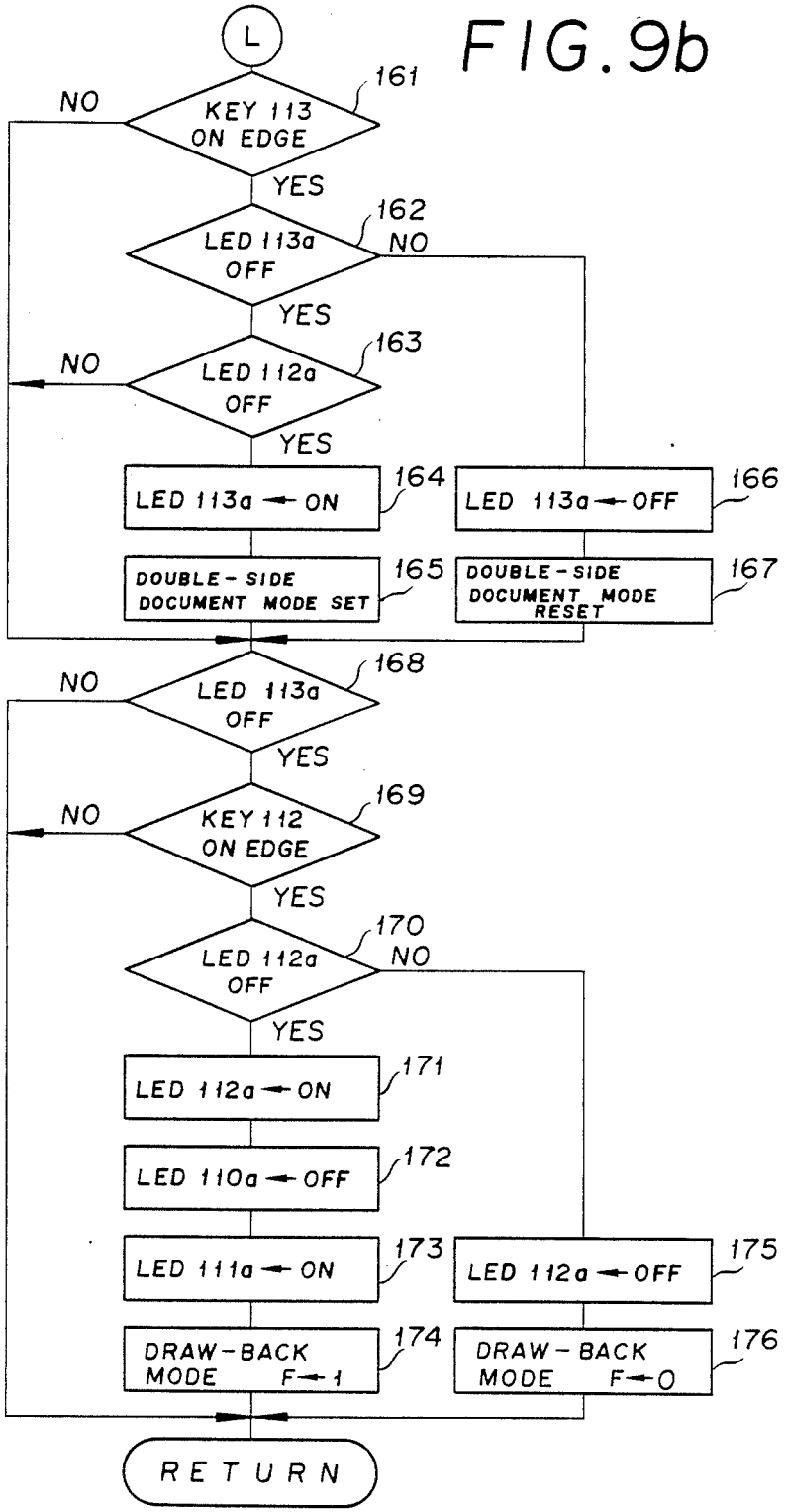

FIG. 9*a* and FIG. 9*b* are flowcharts indicating details of the step 133 in FIG. 7. In this step 133, the double-side copying mode for copying images to both sides of a copy sheet, a composite copying mode for carrying out several copying operations to a single side of a copy sheet, a draw-back mode for causing a sheet type document having completed the copying operation to draw back into the reverse unit 80 and a double-side document mode for copying both images recorded on the front and rear sides of the sheet type document to a copy sheet can be set depending on the input by any one of the keys 110, 111, 112, and 113.

As indicated in FIG. 9*a*, when it is decided in the step 150 that the copying operation is not carried out and it is decided in the step 151 that the composite copying mode is selected in the preceding copying operation, namely LED 111*a* is OFF, it is decided in the step 152 whether the key 110 is turned ON to perform the double-side copying or not. When it is decided in the step 153 that the double-side copying mode is selected in the preceding copying operation and the LED 110*a* turns ON, the LED 110*a* is turned OFF and the double-side copying mode is reset in the step 154. Meanwhile, if it is decided in the step 153 that the double-side copying mode is not selected in the preceding copying operation, the LED 110*a* is turned ON and the double-side copying mode is turned ON under the condition that the composite copying mode is not set, if the double-side copying mode is turned ON under the condition that the composite copying mode is not set, if the double-side copying mode is set in the step 155. As expained earlier, in case the key 110 for setting the double-side copying mode is set in the preceding copying operation, the double-side copying mode is reset, but if the double-side copying mode is not set, the double-side copying mode is set.

Setting and resetting of the composite copying mode can be conducted by the steps from 156 to 160 indicated in FIG. 9 in almost the same procedures as that explained previously.

For the copying of images recorded on both sides of a sheet type document accommodated in the original document tray 81, it is requested to operate the double-side document key 113 showin in FIG. 4. When it is decided in the step 161 indicated in FIG. 9*b* that the double-side document key 113 is in the ON-edge state, it is decided in the step 162 that the LED 113*a* is OFF, namely the double-side documents mode is not set in the preceding copying operation, and moreover the LED 112*a* is OFF and the document draw-back mode is not set, the LED 113*a* lights in the step 164 and the double-side document mode is set in the step 165. Moreover, when the result is NO in the step 162, namely it is decided in the step 161 that the double-side document mode is set in the preceding copying operation the LED 113*a* is turned OFF in the step 166 in order to reset this mode and the double-side document mode is reset in the step 167.

In case a document is to be drawn back into the reverse unit 80 after the completion of copying operation by the document transferred up to the copying position, the key 112 shown in FIG. 4 is operated. When it is decided in the step 168 of FIG. 9*b* that the LED 113*a* which displays double-side document is turned OFF, it is decided in the step 169 that the key 112 for setting the document draw-back mode is in the ON-edge state, and the LED 112*a* which indicates that the document draw-back mode is set in the preceding copying operation is OFF, namely it is decided in the step 170 that the document draw-back mode is not set in the preceding copying operation, the LED 112*a* which indicates that the draw-back mode is selected turns ON in the step 171, the LED 110*a* turns OFF in the step 172, the LED 111*a* turns On in the step 173 and the draw-back mode flag is set to "1" in the step 174. Thereby, the draw-back mode is set. Moreover, when decision is NO, namely it is decided in the step 170 the draw-back mode is set in the preceding copying operation, the LED 112*a* is turned OFF in the step 175 and the draw-back mode flag is reset to "0" in the step 175. Thereby, the draw-back mode is reset.

Figure 10A:
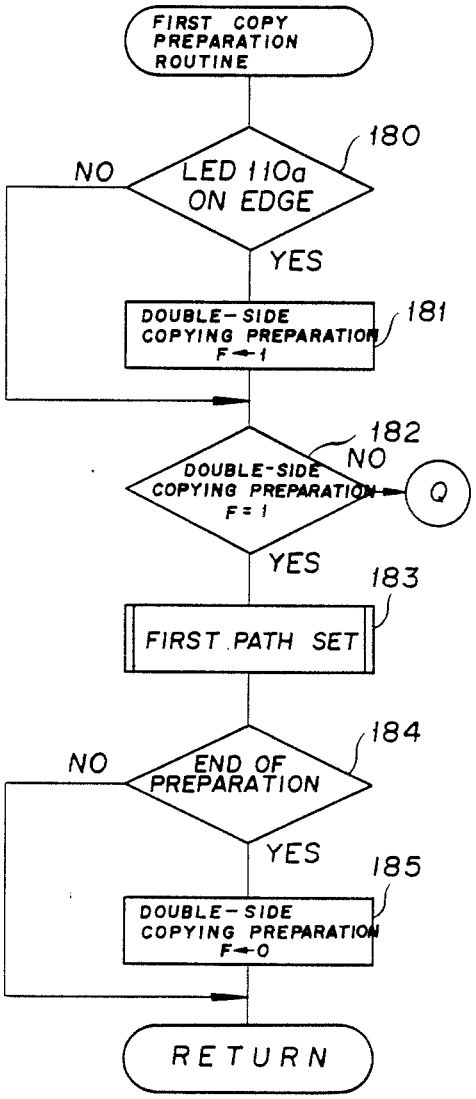
FIG. 10*a* and FIG. 10*b* are flowcharts showing process of the first copying preparation routine.
Figure 10B:
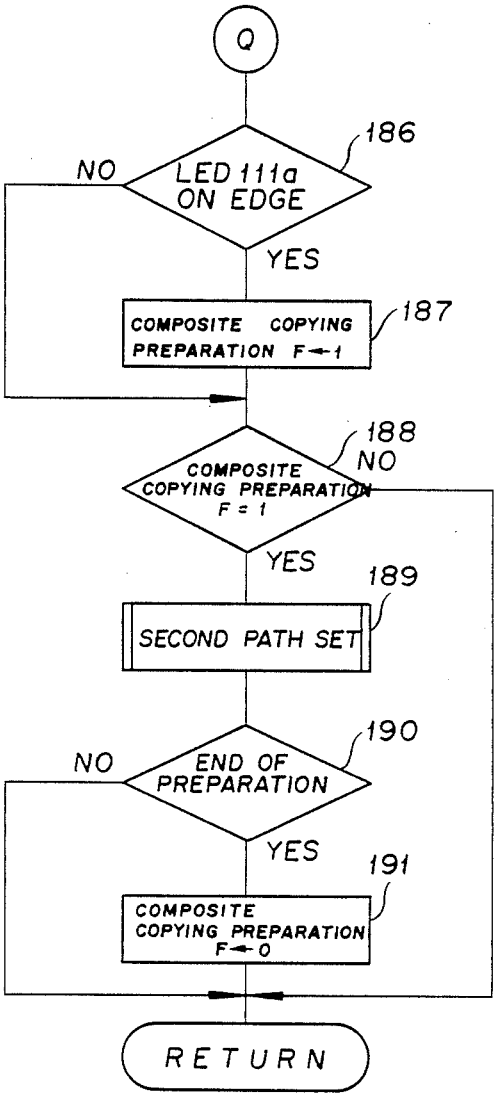

FIG. 10*a* and FIG. 10*b* show details of step 134 in FIG. 7. The step 134 is a routine for setting a paper path in order to guide a copy sheet having completed the first copying operation to the intermediate tray 62 through the paper path 70*a* after having passed the transportation roller pair 68 in case the double-side copying mode is set for realizing the copyings to both front and rear sides of a copy sheet, or to directly guide a copy sheet to the intermediate tray 62 without passing the paper path 70*a* in case the copying operation is carried out twice to a single side of a copy sheet. Such setting is carried out as the preparation before the first copying is conducted.

In FIG. 10*a*, in case it is decided in the step 180 that the LED 110*a* which indicates the double-side copying mode is set is in the ON-edge state, the double-side copying preparation flag is set to "1" in the step 181 and the paper path is set to the double-side document type in the step 183 through the step 182. In the step 183, the changeover lever 64 shown in FIG. 1 is operated to the position indicated by a solid line and the changeover lever 72 is operated to the position indicated by a phantom line. The copy sheet having completed the first copying operation and reached the transportation roller pair 68 is sent to the intermediate tray 62 through the paper path 70*a*. In this case, the copy sheet re-supply roller 73 is moved upward to the position indicated by the phantom line 73*a* by the lever 74. When the setting preparation end of paper path of double-side type is detected in the step 184, the double-side preparation flag is reset to "0" in the step 185.

When it is decided in the step 182 that the double-side preparation flag is not "1" and it is decided in the step 186 that the LED 111*a* which indicates setting of the composite mode is in the ON-edge state, the composite copying preparation flag is set to "1" in the step 187. When it is decided in the step 188 that the composite copying preparation flag is "1", the paper path is set to the composite type in the step 189. Thereby, the changeover lever 72 is set to the position indicated by a solid line in FIG. 1 and the copy sheet having completed the first copying operation passes the transportation roller pair 68, then is guided to the lower side of changeover lever 72 and is directly accommodated in the intermediate tray 62. When it is decided in the step 190 that the paper path for composite copying mode is set, the composite copying preparation flag is reset to "0" in the step 191.

Figure 11:
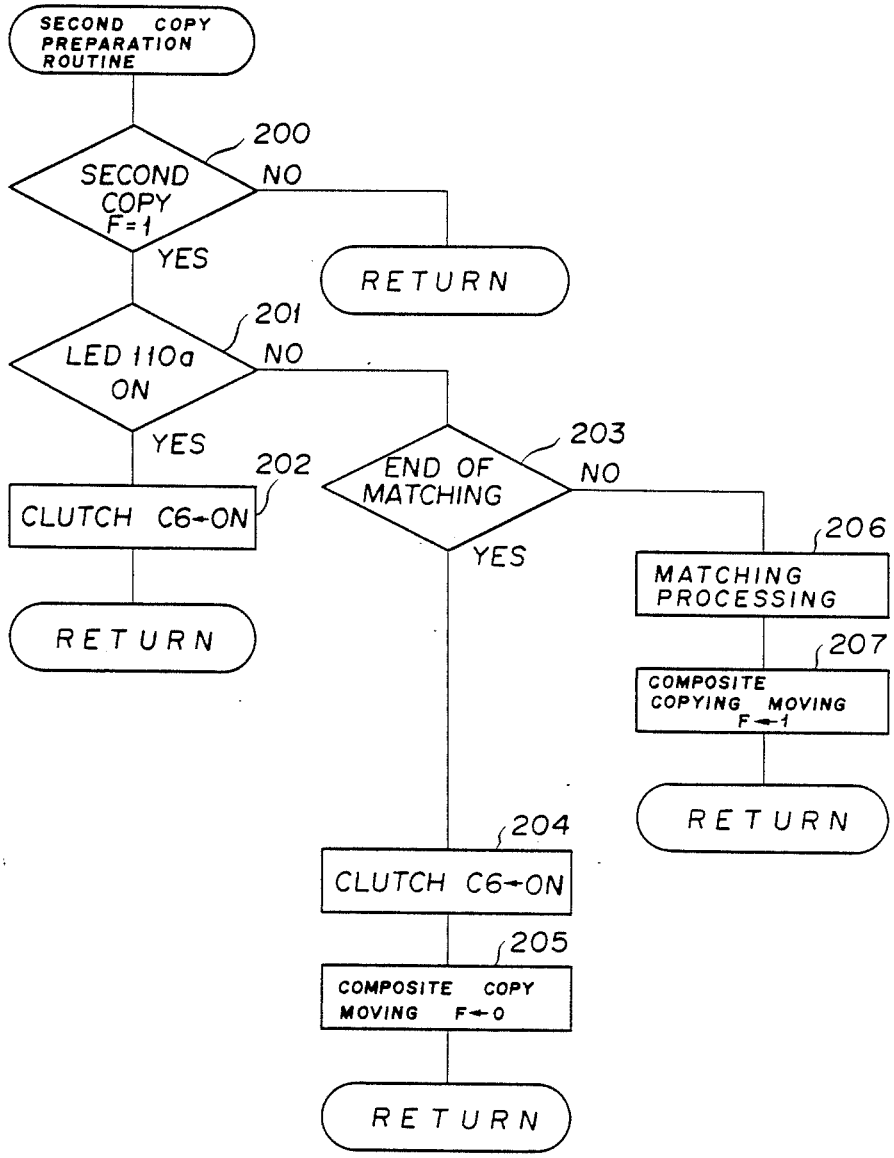
FIG. 11 is a flowchart showing process of the second copying preparation routine.

FIG. 11 is a flowchart indicating details of the step 135 of FIG. 7 and it is the second copying preparation routine for setting initiation of resupply of the copy sheets accommodated in the intermediate tray 62 after the fist copying operation is completed to the copy sheet. When it is decided in the step 200 of FIG. 11 that the second copy flag is set to "1" in the step 256 explained later and it is also decided in the step 201 that the LED 110*a*, which indicates that the double-side copying mode is set, is ON, the clutch C6 for operating the copy sheet resupply roller 73 turns ON in the step 202. When it is decided in the step 201 that the LED 110*a* does not turn ON and it is decided in the step 203 that the matching is completed, the clutch C6 is turned ON in the step 204 for driving the copy sheet resupply roller 73 and the composite moving flag is reset to "0" in the step 205. When it is decided in the step 203 that the matching is not yet completed, the matching process is carried out in the step 206 and the composite moving flag is set to "1" in the step 207. The matching process in the step 206 is the process for positioning the end part of the copy sheet, because the end part of sheet is not positioned to the end part of the intermediate tray 62 under the condition that the copy sheet which has completed the first copying operation is sent directly to the intermediate tray 62 by the transportation roller 68 in case the composite copying is to be carried out to the copy sheet. In this case, the copy sheet which has completed the first copying is transported to the left end in the intermediate tray 62 for matching by moving the guide palte 76 with the solenoid SL10 indicated in FIG. 1. The composite moving flag is set for execution of the matching movement of copy sheet.

FIG. 12*a*, FIG. 12*b*, FIG. 12*c* and FIG. 12*d* are flowcharts indicating details of the step 136 in FIG. 7. This step 136 is a routine for controlling the copying operation.

Figure 12A:
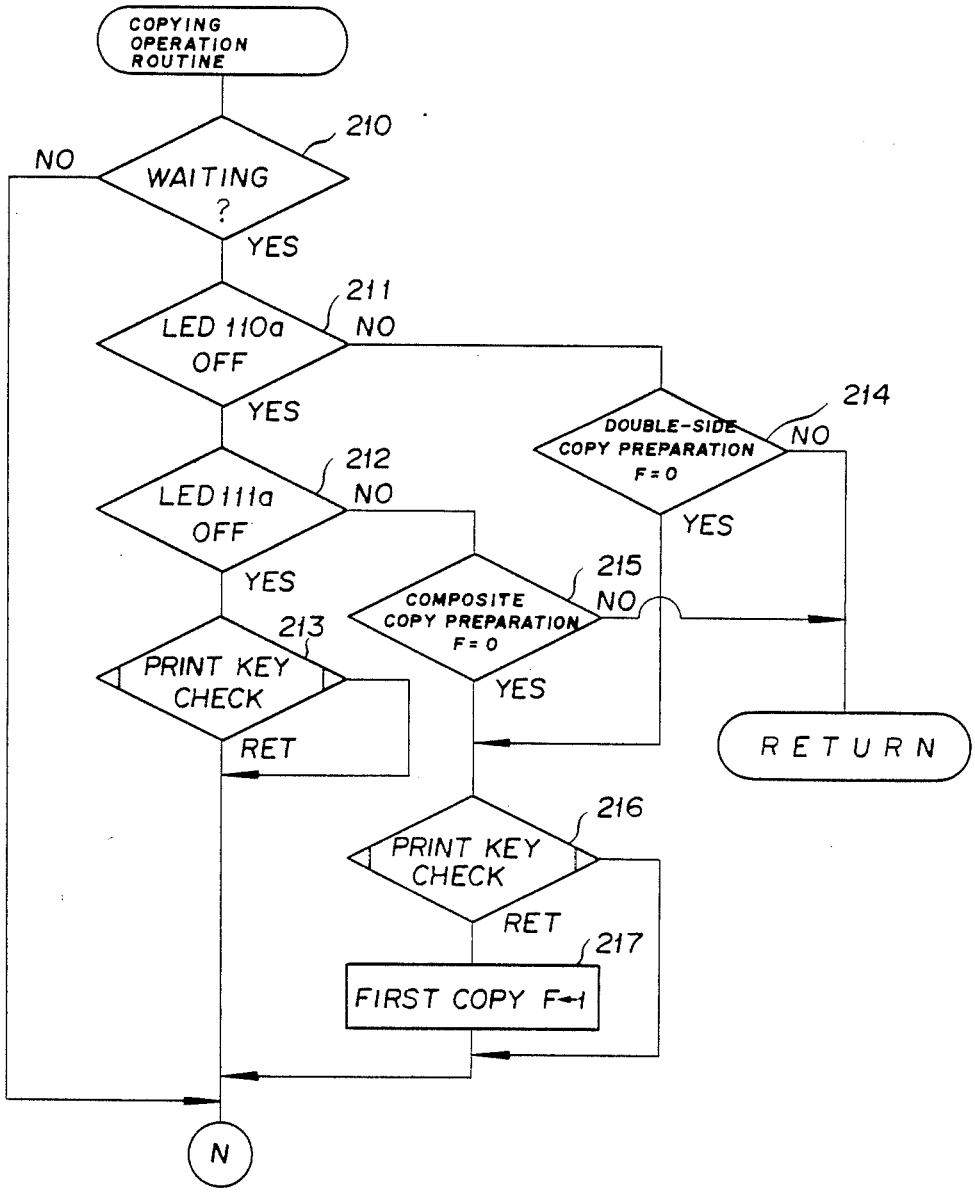
FIG. 12*a* to FIG. 12*d* are flowcharts showing process of the copying operation routine.

In the steps 210 to 217 indicated in FIG. 12*a*, the processings for the copy sheet under the waiting condition are executed. When it is decided in the step 210 that the copying apparatus is in the waiting condition and it is also decided in the steps 211 and 212 that any of the double-side copying mode and composite copying mode is not set, the print key check subroutine indicated in the step 213 is immediately executed. When it is decided in the step 211 that the double-side copying mode is set and it is decided in the step 214 that the paper path for double-side copying mode is reset in the step 185 in FIG. 10*a*, the print key check subroutine explained above is executed in the step 216. In the same way, when it is decided in the step 212 that the composite copying mode is set and it is decided in the step 215 that the paper path for composite copying mode is set in the step 191 in FIG. 10*b*, the step 216 explained above is executed. When this step 216 is executed, the first copy flag is set to "1" in the step 217.

Figure 13:
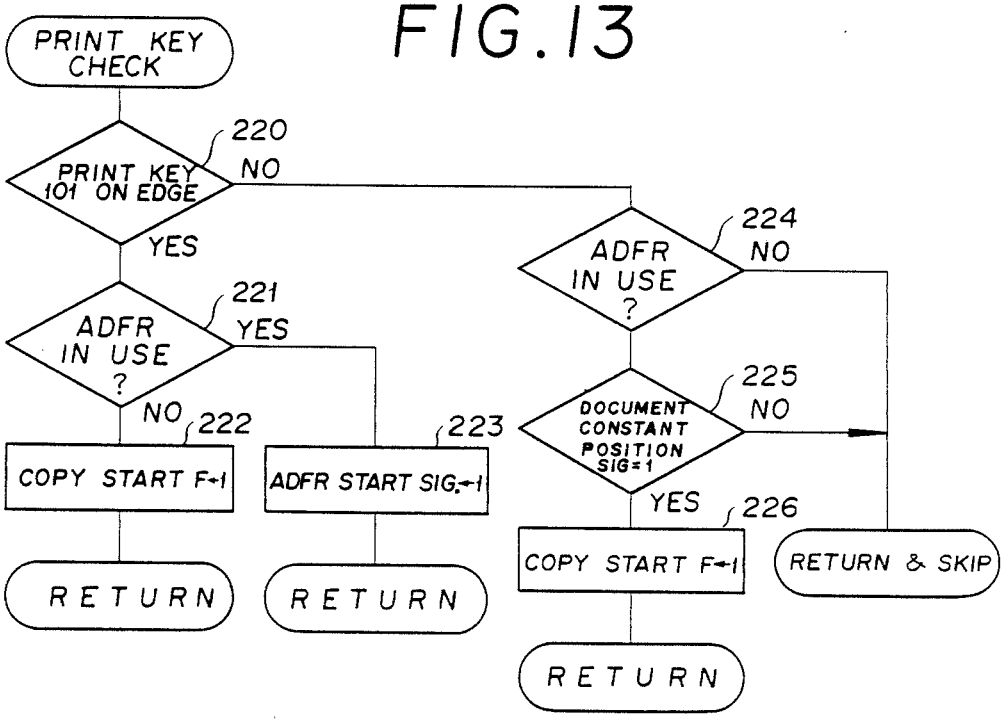
FIG. 13 is a flowchart showing process of the print key check routine.

Here, the print key check subroutine explained above is explained with reference to FIG. 13.

When it is decided that the print key 101 is ON as indicated in step 220 and it is decided in the step 221 that ADFR 77 is not in the ready condition (for instance, ADFR 77 and the copying apparatus are electrically connected), the copy start flag is set to "1" in the step 222. Meanwhile, when it is decided in the step 221 that the ADFR 77 is ready for use, the start signal for ADFR 77 is generated in the step 223.

Thereby, supply of document is started by the signal sent from the third CPU 123 for controlling ADFR 77. Moreover, when NO is decided in the step 220 and it is also decided that the document is set to the specified position by ADFR 77 after generation of ON-edge signal of print key 101, the copy start flag is set in the step 226 through the steps 224 and 225 and thereby the copying operation is started.

Figure 12B:
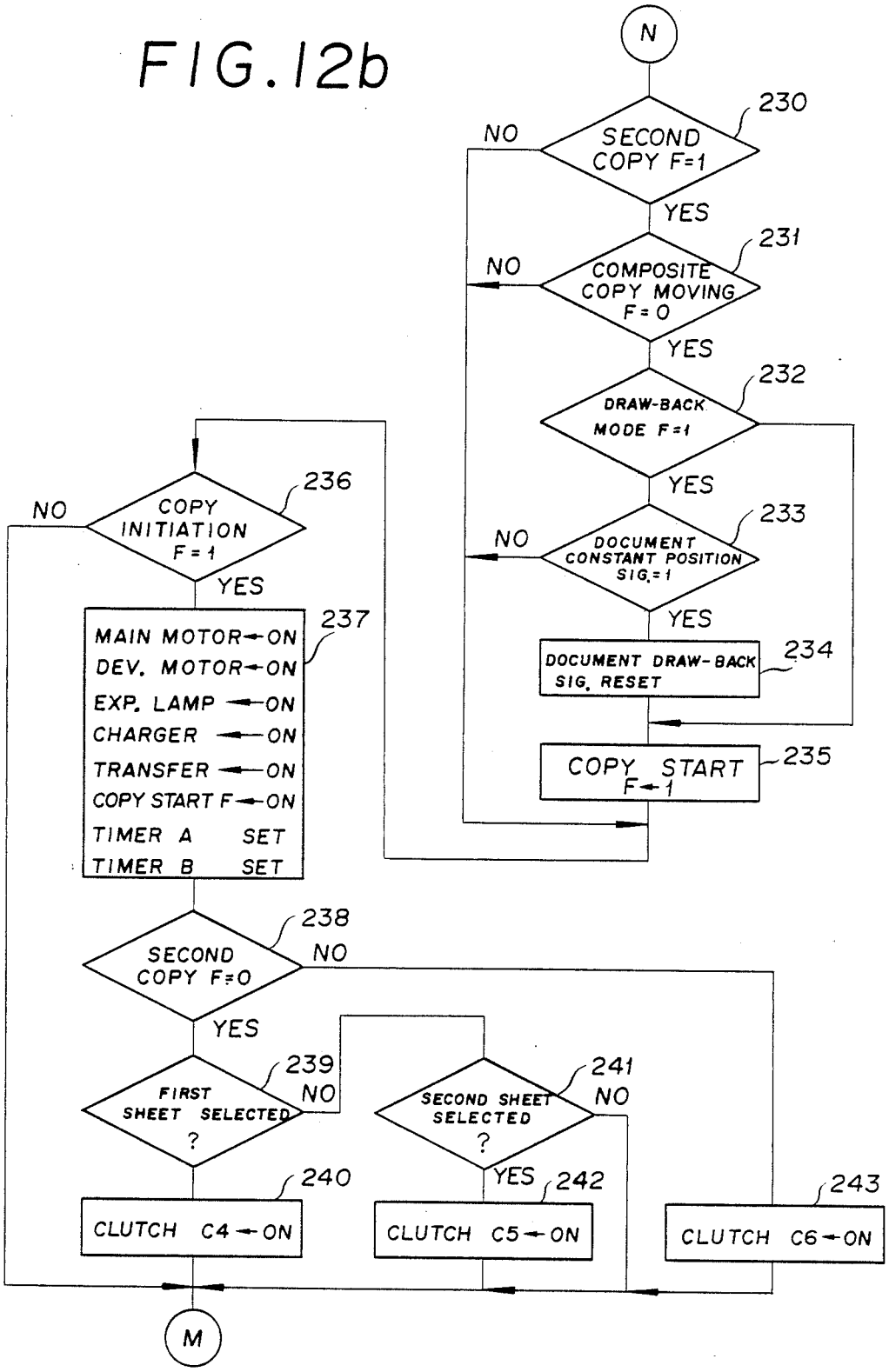

Next, a flowchart shown in FIG. 12*b* is expalined. In the steps 230 to 235 in the same figure, the processings before initiation of the copying operation are executed.

When it is decided in the step 230 that the second copying flag is set in the step 256 explained later and it is decided in the step 231 that it is possible to supply again the copy sheet in the intermediate tray 62 in the step 205 in FIG. 11, the copy start flag is set to "1" in the step 235 under the condition (refer to the step 174) that "NO" is decided in the steps 232, namely the draw-back mode is not yet set to "1". When it is decided in the step 232 that the draw-back mode is set, after it is confirmed in the step 233 (refer to step 352 explained later) that the document is set to the predetermined copying position from the reverse unit 80 of ADFR 77, the document draw-back signal is reset in the step 234 and then the copy start flag is set to "1" in the step 235.

The processings at the time of starting the copying operation are indicated in the steps 236 to 243 in FIG. 12*b*.

When the copying initiation signal is decided in the step 236, the main motor is turned ON and the copying operation is started in the step 237. In this case, when it is decided in the step 238 that the copying operation is the first copying operation and it is decided in the step 239 that a copy sheet in the first cassette 53 is selected, the clutch C4 is operated in the step 240 in order to operate the copy sheet supply roller 55. Moreover, it is decided in the step 241 that the copy sheet in the second cassette 54 is selected, the clutch C5 is operated in the step 242 in order to drive the copy sheet supply roller 57. In addition, when NO, namely, the second copying operation is decided in the step 238, the clutch C6 is operated in the step 243 in order to drive the copy sheet resupply roller 73.

Figure 12C:
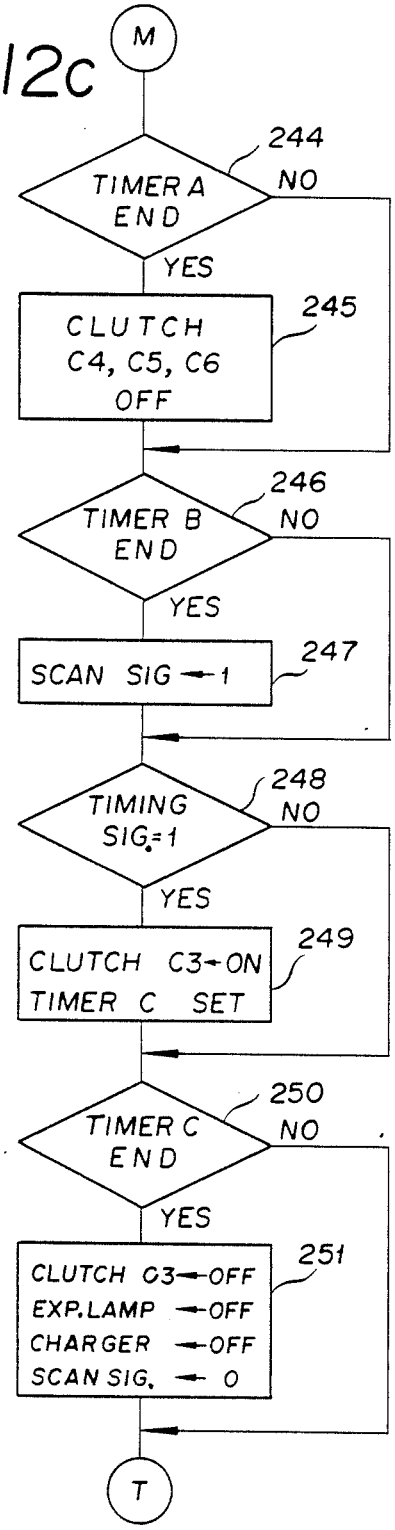

In the steps 244 to 251 in FIG. 12*c*, the OFF times of respective devices during the copying operation are controlled by the timer.

The timer A is used for setting the OFF time of respective clutches C4, C5, C6, while the timer B is used for setting the generation time of scan signal to be sent to the optical system 30. These timers A and B are turned ON in the step 237 in FIG. 12*b*. When the end of timer A is decided in the step 244, the clutches C4, C5, C6, are turned OFF in the step 245. When the end of timer B is decided in the step 246, the scan signal is generated in the step 247 and if a timing signal is sent from the optical system 30, the clutch C3 is operated for driving the timing roller 47 in the step 249 and the timer C is also turned ON. The timer C is used for controlling the OFF time of the clutch C3 for timing roller 47, exposure lamp 32, corona charger 45 and scan signal. When the end of timer C is detected in the step 250, the clutch C3 is turned OFF in the step 251.

Figure 12D:
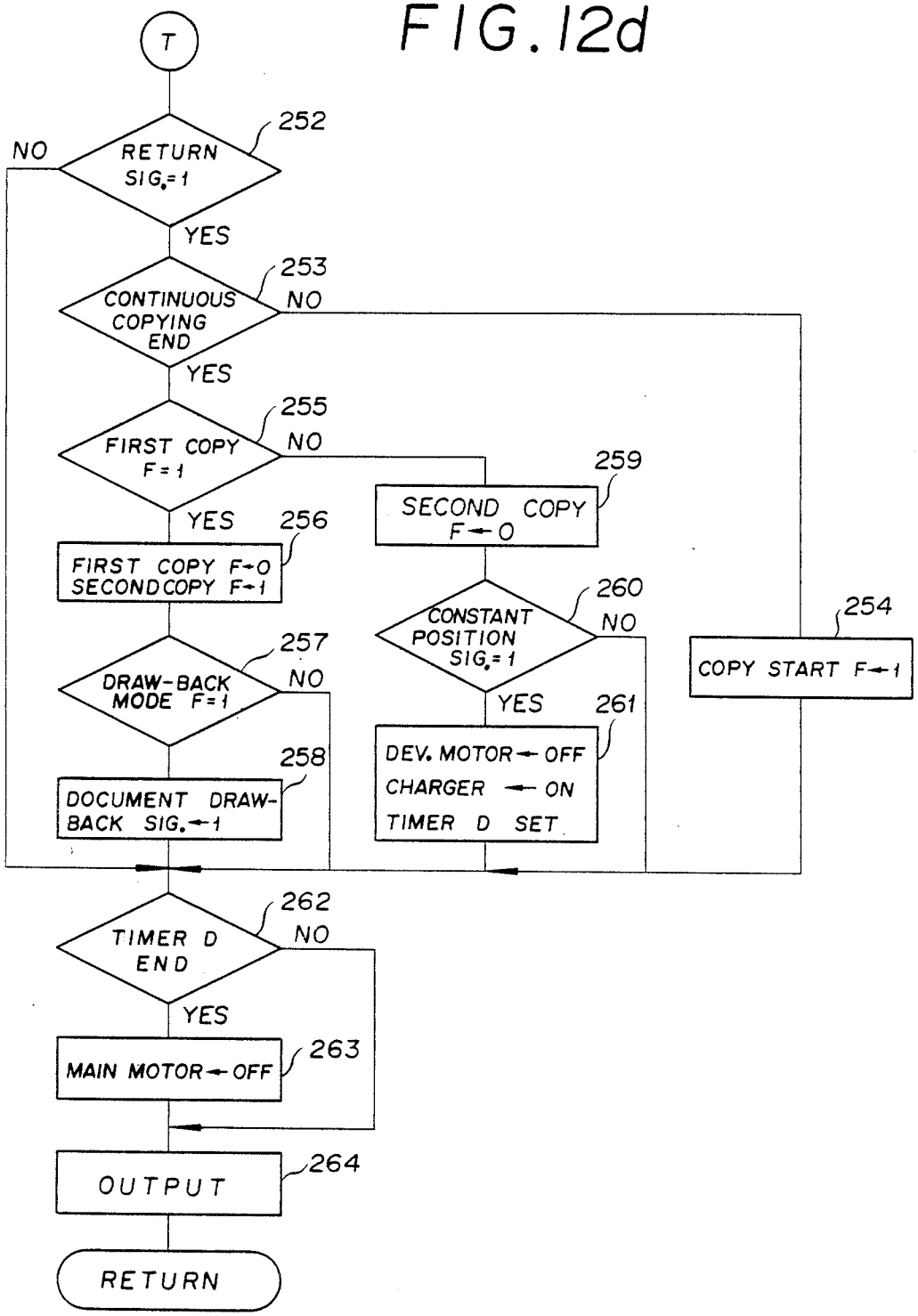

The steps 252 to 264 in FIG. 12*d* indicate the processings carried out after the time where a return signal is sent from the second CPU 122 provided to control the optical system 30.

When the return signal is detected in the step 252, it is then decided in the step 253 whether all copying operations are completed or not in the copying operation to many sheets of copy sheet. When it is decided that all copying operations are not completed, the copy initiation flag is set to "1" in the step 254 for the next copying operation by the same document. In case, it is decided in the step 253 that all copying operations are completed, it is then decided in the step 255 that the copying operation completed has been the first copying or not in the double-side copying or composite copying operation. When it is decided in the step 255 that the copying operation completed has been the first copying, the first copy flag is reset to "0" in the step 256 and the second copy flag is set to "1". Moreover, when it is decided in the step 257 that the draw-back mode is set, a document draw-back signal is generated in the next step 258. Thereby, the document used for the first copying operation is drawn back and is accommodated in the reverse unit 80 by the transportation belt 85. In case it is decided in the step 255 that the second copying operation has been completed, after the second copying flag is reset in the step 259 and the scanning elements of the optical sytem 30 is returned to the specified position in the step 260, the developing motor M2*a* or M2*b* is turned OFF in the step 261, the transfer charger 41 is turned OFF and moreover the timer D is set. When the end of timer D is decided in the step 262, the main motor Ml is turned OFF in the step 263 and an output signal is executed in the step 264.

Figure 14:
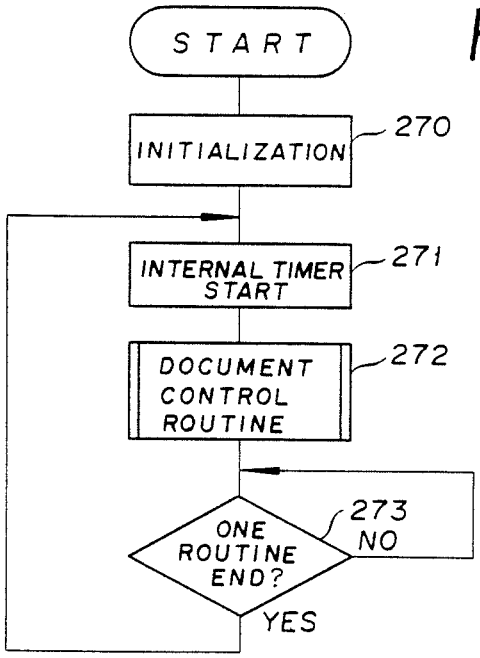
FIG. 14 is a flowchart showing process of main routine of the third CPU which controls the automatic document feeder.

FIG. 14 is a flowchart indicating the main routine of the third CPU 123 for controlling operation of ADFR 77.

The third CPU 123 starts the processings, for example, when the power is turned ON and initializes the apparatus in the step 270. Thereafter, it starts an internal timer which specifies the time of one routine in the step 271. Thereafter, the CPU 12 executes control for supply and discharge of document in the step 272, returns the operation to the step 271 after the end of internal timer in the step 273 and then repeats the above processings.

Figure 15A:
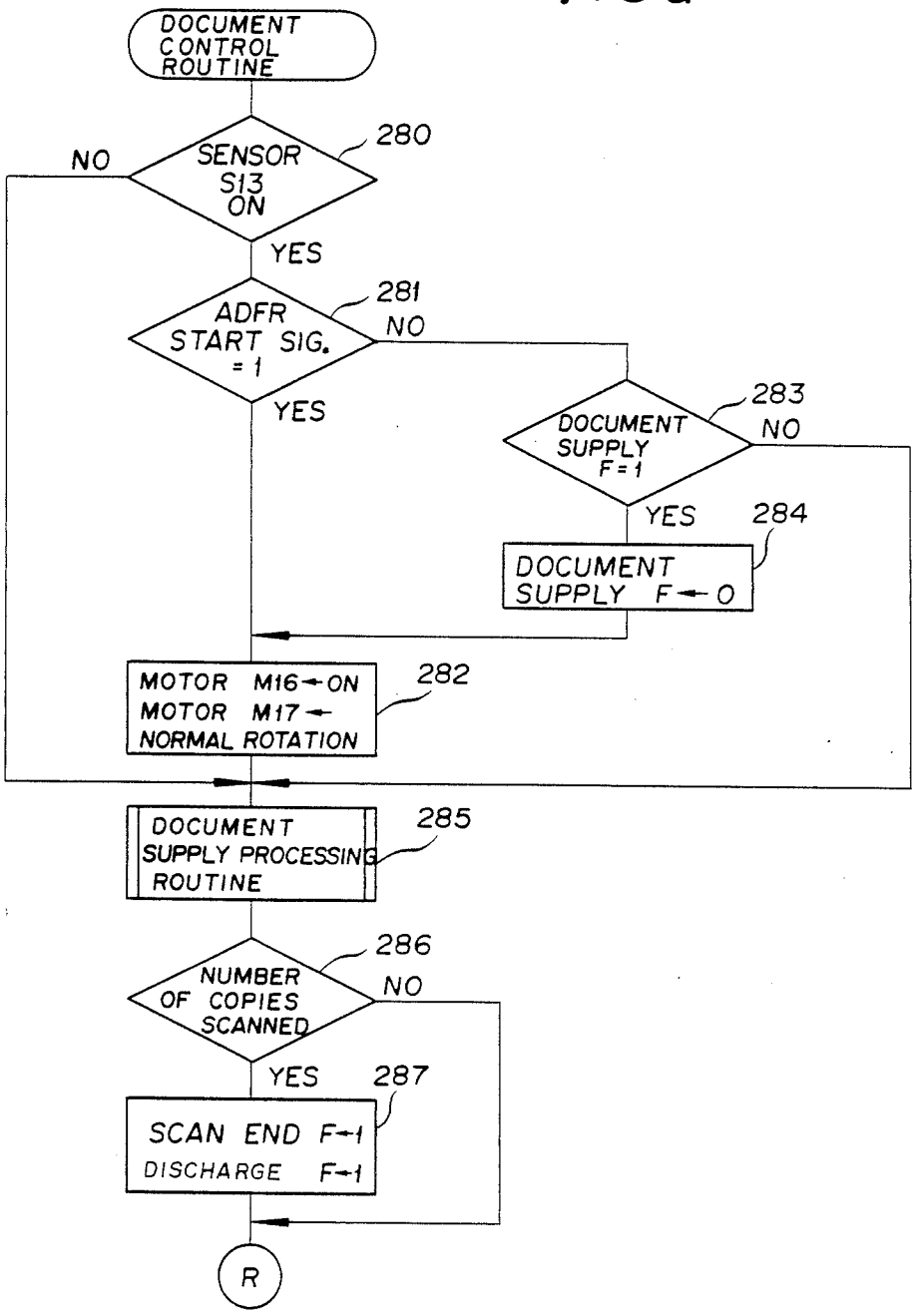
FIG. 15*a* to FIG. 15*c* are flowcharts showing process of document control routine.
Figure 15B:
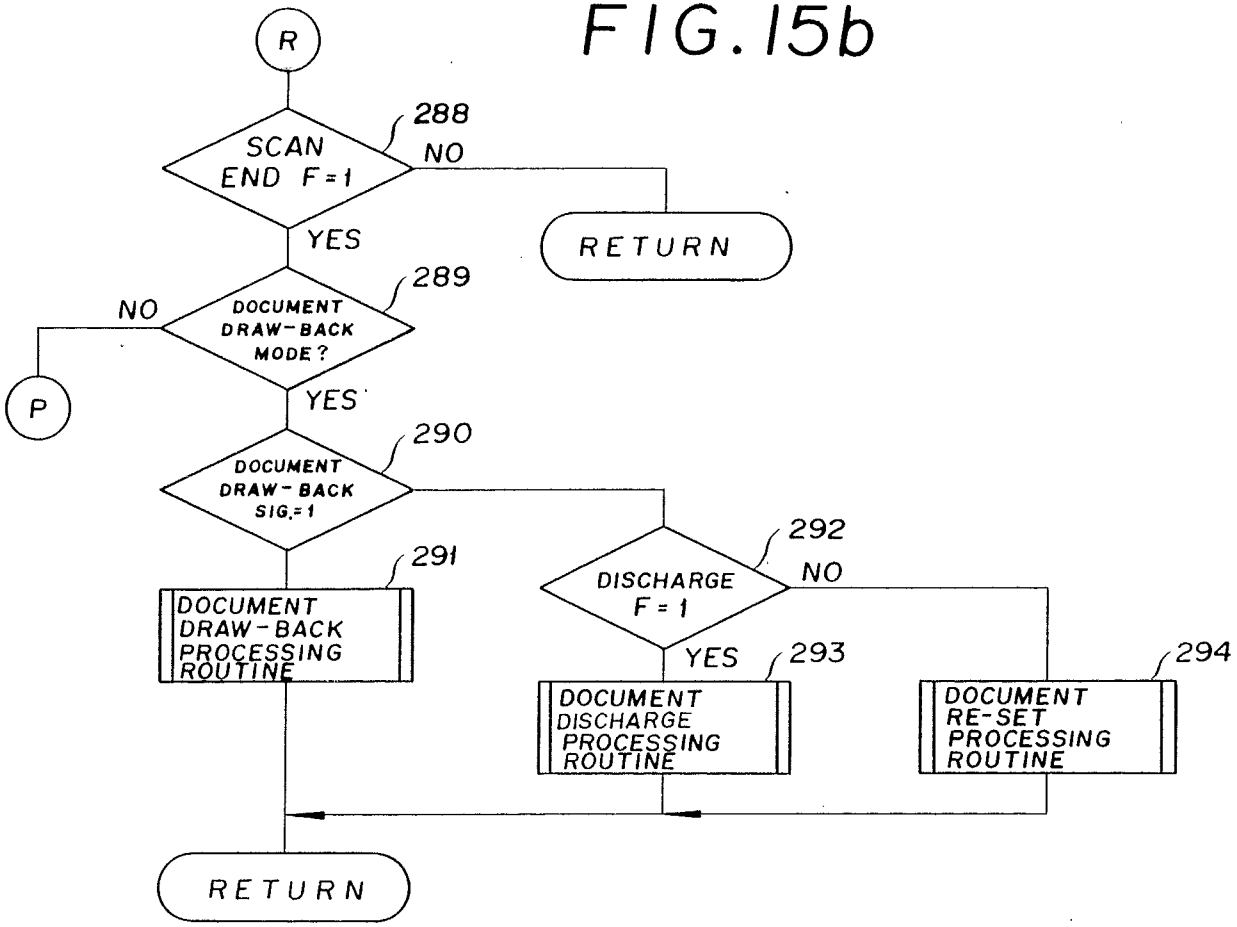
Figure 15C:
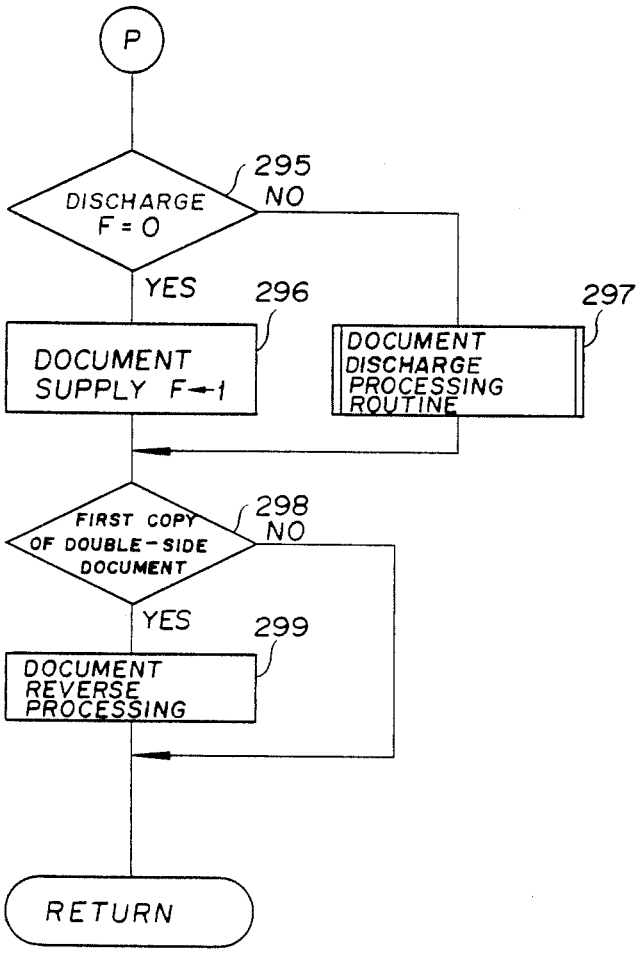

FIG. 15*a*, FIG. 15*b* and FIG. 15*c* show details of document control routine indicated in the step 272 of FIG. 14. When the sensor S13 is ON and it is decided that a document exists on the original document tray 81 in the step 280 and it is decided in the step 281 that the start signal of ADRF 77 is generated in the step 223 of FIG. 13, a motor M16 for driving the transportation roller 82 in the document supplying unit 79 indicated in FIG. 1 turns ON and a motor M17 for driving the transportation belt 85 rotates normally (step 282). Moreover, when it is decided in the step 283 that the document supply flag is set even if the start signal of ADFR 77 is not generated in the step 281, the step 282 is executed after the document supply flag is reset in the step 284. The document supply flag is set when a document is discharged to the document discharge tray 86 from the copying position as indicated in the step 296 explained later and when a document is drawn back to the reverse unit 80 of ADFR 77 as indicated in the step 325 explained later.

Figure 16:
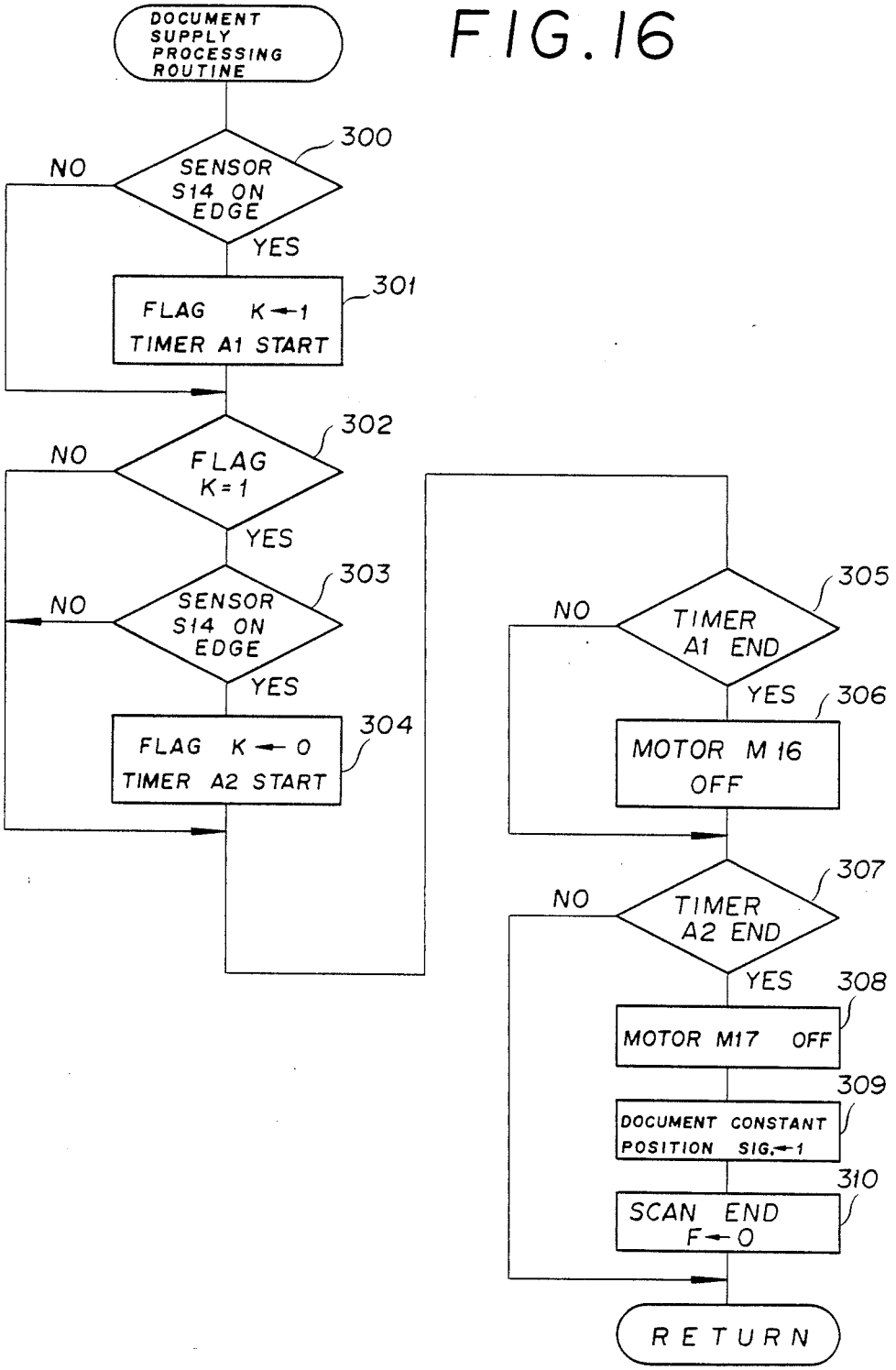
FIG. 16 is a flowchart showing process of document supply processing routine.

Next, the document supply processing routine inidcated in the step 285 in FIG. 15*a*, FIG. 16 is executed. This processing transports a document to the specified copying operation on the transparent document support table 29 from the document tray 81 and will be explained later in detail.

In the step 286, it is decided by the signal sent from the first CPU 121 whether a required number of times of scannings for exposure has been conducted or not for the document being set on the transparent document support table 29. When YES is decided in this step, a scan end flag is set to "1" in the step 287 and an discharge flag is also set. It is detected in the next step 288 that the scan end flag is set and it is detected in the step 289 that the document draw-back mode is set. Moreover, when the document draw-back signal is sent from the first CPU 121 in the step 290 (refer to step 258 in FIG. 12), the document draw-back processing routine of step 291 is executed. In the processing of step 291, a document is sent to the reverse unit 80 of ADFR 77 from the copying position and is then drawn back. Details are explained later.

When it is decided in the step 290 that the document draw-back signal is not set and it is decided in the step 292 (refer to step 287 expalined above and step 353 explained later) that an discharge flag is set, the document discharge processing routine is executed in the step 293. In this processing, the document is discharged to the document discharge tray 86 of ADFT 77. Details are explained later.

When it is decided in the step 292 that the discharge flag is not set, the document reset processing routine of step 294 is executed. In this processing, the document drawn back in the reverse unit 80 of ADFR 77 is reversely sent to the specified copying position on the document support table 29. Dtails are explained later.

In case it is decided in the step 289 that the document draw-back mode is not set, the processings after the step 295 shown in FIG. 15*c* are executed. In the step 295, whether the discharge flag is reset or not is decided. This discharge flag is reset when the document is discharged to the document discharge tray 86 from the copying position in the step 335 explained later. When the document is discharged, a document supply flag is set to "1" in the step 296. If the document is not discharged, the document discharge processing routine similar to that in the step 293 is executed in the step 297 in order to discharge the document to the document discharge tray 86.

In the step 298, whether the first surface of the double-side document is suppllied or not is decided. When the first surface is supplied, the document reverse processing step 299 is executed and the document is supplied up to the copying operation with the first surface facing to the document support table 29. Namely, in order to reverse the double-side document, the double-side document accommodated in the draw-back space 88*a* is sent to the copying operation from the opening 94 for exit.

FIG. 16 shows a document supply processing subroutine indicated in the step 285 of FIG. 15*a*.

When the document is detected by a sensor S14 in the transportation unit 78 (step 300), the timer A1 is started in the step 301 and simultaneously a flag K is set to "1". When the OFF-edge of sensor S14 is detected in the step 303 through the step 302, a flag K is reset in the step 304 and a timer A2 is started. The step 303 becomes the ON-edge in the step 300 for the same document. The timer A2 controls the operation time of motor M16 which drives the transportation roller 82, while the timer A2 controls the operation time of motor M17 which drives the transportation belt 85.

Accordingly, when the end of timer A1 is decided in the step 305, the motor M16 stops in the step 306 and when the end of timer A2 is decided, rotation of motor M17 stops and the transportation belt 85 stops thereby in the step 308. Thereafter, a document is set to the specified copying position on the document support table 29. Under this condition, a document constant position signal is generated in the step 309 and a scan end flag is reset in the step 310. Thereby, the document on the document tray 81 is set to the specified position on the document table 29.

Figure 17:
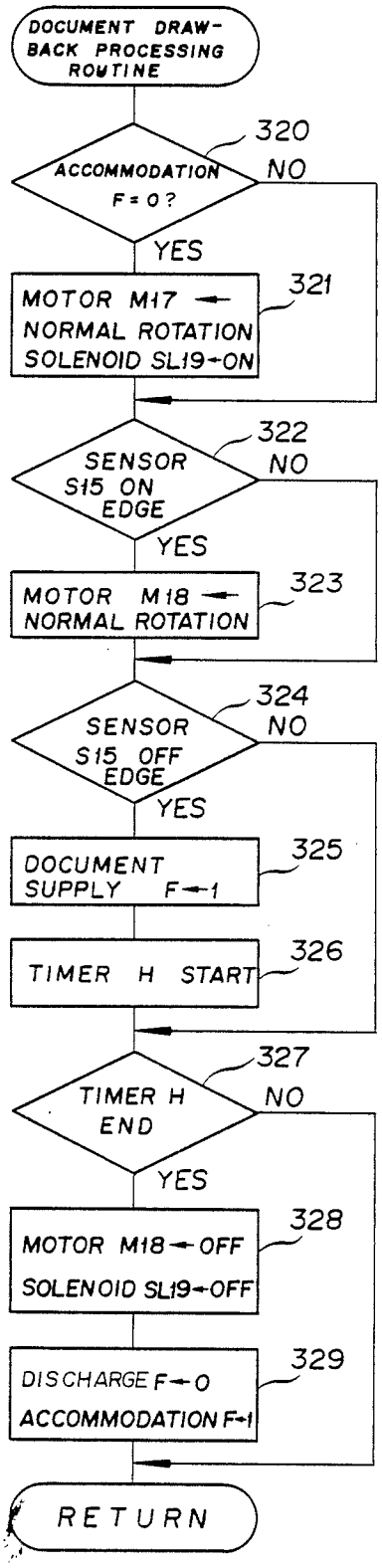
FIG. 17 is a flowchart showing process of document draw-back processing routine.

FIG. 17 shows a document draw-back processing subroutine of the step 291 indicated in FIG. 15*b*.

In case the accommodation flag is "0", namely it is decided that a document is not drawn back in the reverse unit 80 in the step 320, the changeover pawl 87 is moved upward by turning ON the solenoid SL 19 and the transportation belt 85 is operated by turning ON the motor M17 in the step 321. Thereby, a document on the transparent document table 29 is transported toward the reverse unit 80.

When a document moving toward the reverse unit 80 is detected by a sensor S15 in the step 322, the motor M18 is rotated normally as indicated in the step 323 to start the draw-back of document to the draw-back space 88*a* in the reverse unit 80. When OFF-edge of sensor S15 is detected in the step 324, a document supply flag is set to "1" in the step 325 and a timer H is set in the step 326. The timer H controls a driving time of the motor M18 from the condition where the rear end of document reaches the sensor S15 to the condition where the document is fully accommodated in the draw-back space 88*a* in the reverse unit 80. When the end of timer H is decided in the step 327, the motor M18 stops and solenoid SL19 turns OFF in the step 328 and moreover an discharge flag is reset and the accommodation flag is set in the step 329. The draw back of document to the reverse unit 80 is carried out as explained above.

Figure 18:
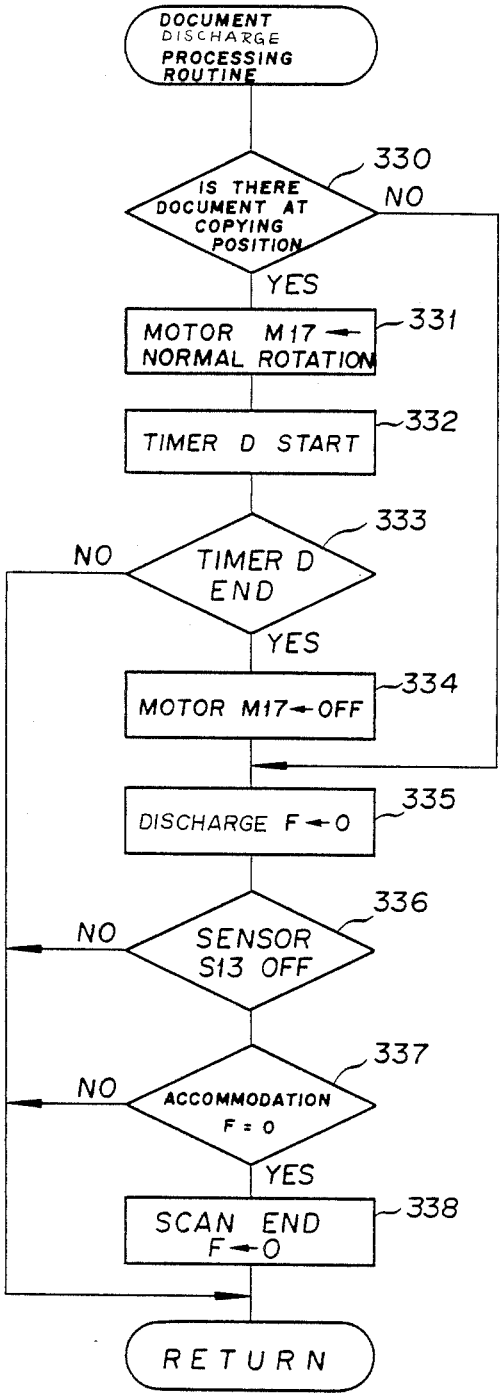
FIG. 18 is a flowchart showing process of document discharge processing routine.

FIG. 18 shows a document discharge processing subroutine indicated in the step 293 of FIG. 15*b*.

When it is decided in the step 330 that a document exists at the specified copying position on the document support table 29, the motor M17 is rotated normally to start operation of the transportation belt 85 in the step 331 and a timer D is started in the step 332. This timer D controls the time from initiation of discharge of document toward the document discharge tray 86 to the end of discharge of document. A value of timer D is set to a sufcient time required for discharge of document. When the end of timer D is decided in the step 333, the motor M17 for operating the transportation belt 85 turns OFF in the step 334 and the discharge flag is reset the step 335.

Next, when it is detected by a sensor S13 that there is no document on the document tray 81 as indicated in the step 336 and it is also decided in the step 337 that the accommodation flag is reset, the scan end flag is reset in the step 338. As explained above, discharge processing of document toward the document discharge tray 86 is executed.

Figure 19:
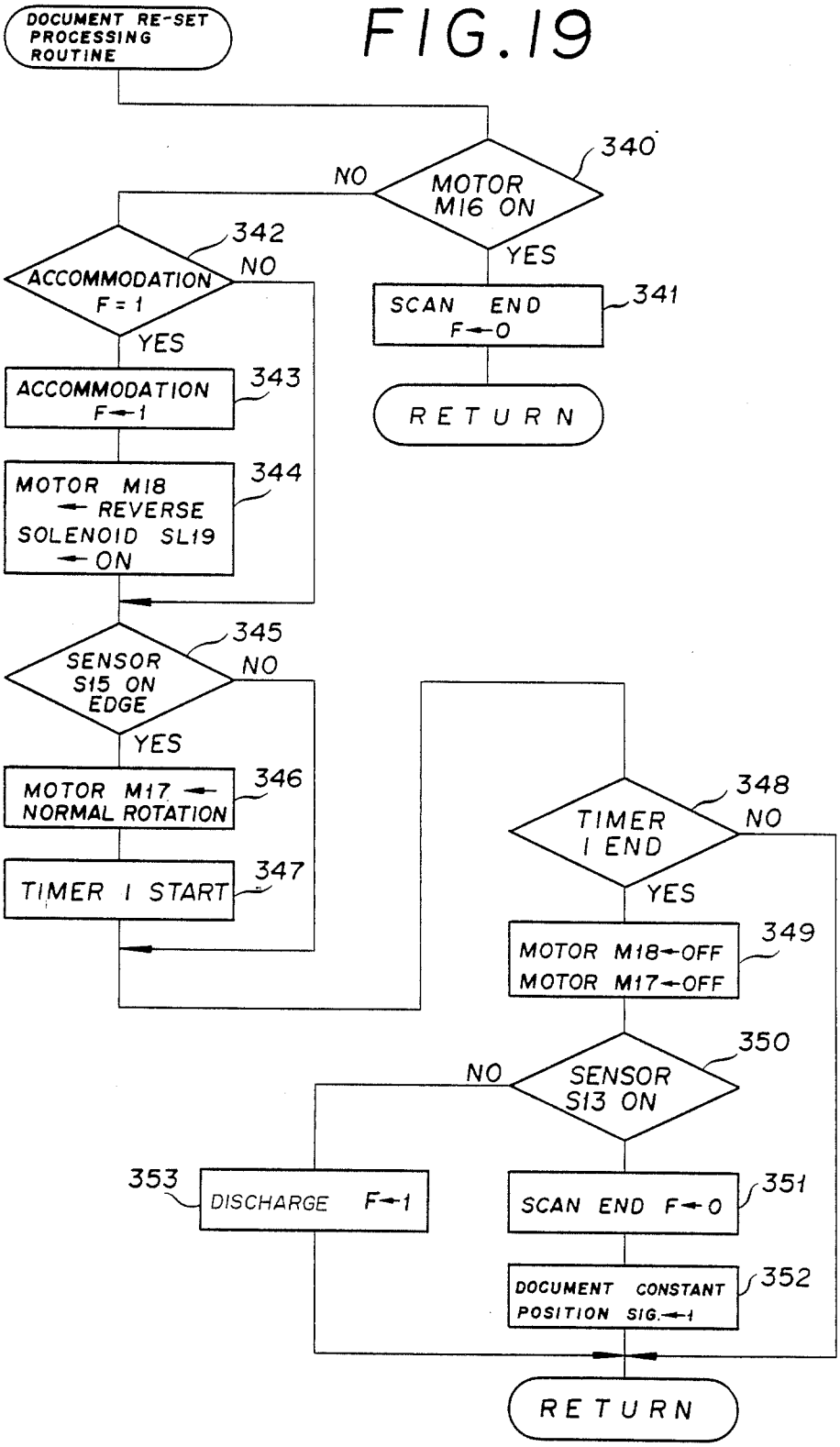
FIG. 19 is a flowchart showing process of document re-setting processing routine.

FIG. 19 is a flowchart indicates details of document reset processing subroutine of the step 294 shown in FIG. 15*b*.

When it is decided in the step 340 that the motor M16 for sending a document is ON, the scan end flag is reset (step 341). When it is decided in the step 340 that the motor M16 is OFF and it is decided in the step 342 that the accomodation flag is set, such accommodation flag is reset (step 343) to reversely rotate the motor M18 in the reverse unit 80 and the solenoid SL19 for driving the changeover pawl 87 turns ON to move the changeover pawl 87. Thereby, a document accommodated in the draw-back space 88*a* in the reverse unit 80 is supplied again toward the copying position of document support table 29. When the document entering the transportation unit 78 from the reverse unit 80 is detected by a sensor S15 as indicated in the step 345, the motor M17 for operating the tranportation belt 85 is rotated reversely in the step 346 and a timer I is started in the step 347. This timer I controls a reverse rotation time of motor M17. When the time up of timer I is decided in the step 348, the motors M17 and M18 are caused to stop respectively in the step 349.

When it is detected by the sensor S13 in the step 350 that another document is accommodated on the document tray 81 of document supplying unit 82, the scan end flag is reset in the step 351 and the document constant position signal is set in the step 352. Meanwhile, when it is detected by the sensor S13 in the step 350 that another document is not accommodated on the document tray 81, a document discharge flag is set in the step 353. Thereby, a document sent from the reverse unit 80 can be set again.

Figure 20:
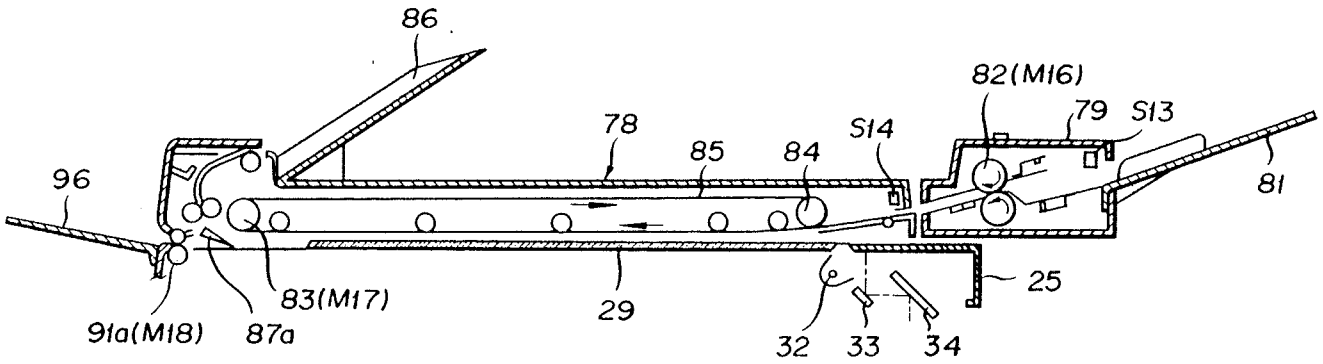
FIG. 20 is a sectional view of the automatic document feeder of the copying apparatus of another embodiment of the present invention.

FIG. 20 shows an automatic document feeder of another embodiment of the copying apparatus of the present invention. In this figure, the parts common to the structural elements of automatic document feeder in the copying appratus shown in FIG. 1 are given the same symbols.

In this case, the reverse unit 80 of FIG. 1 is replaced with a document tray 96. Therefore, the apparatus provides a pair of document tray, a first document tray 96 and a second document tray 81 of the document supplying unit 79. For the copying operation particular to the apparatus of the present invention indicated in FIG. 3*a* to FIG. 3*d*, the first document D1 is supported by the first document tray 96 and a plurality of second document D2, D3 are supported on the second document tray 81 under the stacked condition. When the copying operation is started under the condition that determined documents are supported by the document tray 96, 81, the first document D1 on the first document tray 96 is first driven by the transportation roller 91*a* and transportation belt 85 and then transported to the determined copying position on the document support table 29. In this case, the end part of changeover pawl 87*a* moves upward and is apart from the surface of document support table 29. Under this condition, a graphic figure image F of the first document D1 is formed, as indicated in FIG. 3*a*, to a copy sheet P1 by the scan operation of image forming optical system 30.

Thereafter, after the first document D1 is returned to the first document tray 96, the second document D2 supported by the second document tray 81 is driven by the transportation roller 82 and the transportation belt 85 and is transported to the determined copying position. Thereby, an image "A" of the second document is copied on the copy sheet P1 as indicated in FIG. 3*b* after the image F of the first document is copied thereto.

The second document D2 having completed the copying operation is driven by the transportation belt 85 and is discharged to the discharge tray 86 under the operation of the changeover pawl 87*a*. As in the case explained above, a common graphic image F of the first document D1 and additional letter image "B" of the second document D3 are combined and copied to the other copy sheet P2 as indicated in FIG. 3*c* and FIG. 3*d*.

Here, even in the copying apparatus of the present invention shown in FIG. 20, as explained earlier, all documents are sent from the second document tray 81 and thereby it is allowed that the first document tray 96 is used only for drawing back the first document.

In addition, in above embodiment, when the draw-back mode is set in the step 169, as indicated in the steps 169 to 176, the composited copying mode is set automatically in the step 169, but, for instance, it is allowed that the double-side copying mode is set automatically in case the draw-back mode is set.

What is claimed is:

1. A copying apparatus comprising;

a document exposure means for exposing a document, an image forming means for forming an image of a document on a copy sheet, a first document supply means which accommodates a first document, transports this first document to the document exposure means, causes the first document to draw back automatically after an image of the first document is formed by the image forming means and accommodates again the first document, a second document supply means which accommodates plural second documents, transports these second documents one by one to the document exposure means and discharges each second document after an image of that second document is formed by the image forming means, and means for alternatively operating the first document supply means and the second document supply means in such a manner that the first document is supplied to the exposing means every time one of the second documents is discharged.

2. A copying apparatus according to claim 1, wherein the first document supply means accommodates a document which has been sent first to the document exposure means by the second document supply means and has completed the copying operation.

3. A copying apparatus according to claim 2, wherein the first document supply means accommodates the first document after the completion of copying operation, then reverses the document upside down and sends again the first document to the document exposure means.

4. A copying apparatus according to claim 2, wherein the first document supply means accommodates the first document after the completion of copying operation and transports again such first document to the document exposure means with the surface, copied in the preceding copying operation, faced to the document exposure means.

5. A copying apparatus comprising;

a document exposure supply means for exposing a document, a first document supply means for supplying a first document to the document exposure means, a second document supply means for supplying a second document to the document exposure means, and an image forming means for forming an image of the first document supplied from the first document supply means to the one surface of a copy sheet and also forming an image of the second document supplied by the second document supply means to the other surface of the copy sheet already having the image formed to the one surface, wherein the first document supply means accommodates a sheet of the first document, supplies the first document to the document exposure means and accommodates again the first document after the exposure to the first document, and the second document supply means accommodates plural sheets of the second document, supplies the second document sheet by sheet to the document exposure means and discharges the second document after the exposure of the second document.

6. A copying apparatus according to claim 5, wherein the first document supply means accomodates a document which has been sent first to the document exposure means from the second document supply means.

7. A copying apparatus according to claim 6, wherein the first document supply means reverses upside down the accommodated document and then sends again the document to the document exposure means.

8. A copying apparatus according to claim 6, wherein the first document supply means sends again the accommodated document to the document exposure means with the surface exposed in the preceding copying operation faced to such document exposure means.

9. A copying apparatus comprising;

a document exposure means for exposing a document, a first document supply means for supplying a first document to the document exposure means, a second document supply means for supplying a second document to the document exposure means, and an image forming means for forming an image of the first document supplied from the first document supply means and an image of the second document supplied by the second document supply means on the same surface of copy sheet, wherein the first document supply means accommodates a sheet of the first document, supplies the first document to the document exposure means and accommodates again the first document after the exposure of the first document, and the second document supply means accommodates a plurality of second documents, supplies the second documents sheet by sheet to the document exposure means and discharges the second documents after the exposure of the second documents.

10. A copying apparatus according to claim 9, wherein the first document supply means accommodates a document which has been sent to the document exposure means from the second document supply means.

11. A copying apparatus according to claim 10, wherein the first document supply means reverses upside down the accommodated document and then sends again the document to the document exposure means.

12. A copying apparatus according to claim 10, where the first document suppy means sends again the accommodated document to the document exposure means with the surface exposed by the preceding exposure faced to the document exposure means.

13. A copying apparatus comprising;

a document exposure means for exposing a document, a first document supply means for transporting a first document to the document exposure means, a second document supply means for transporting a second document to the document exposure means, and an image forming means for forming an image of the first document with a first color and for forming an image of the second document with a second color, wherein the first document supply means accommodates a sheet of the first document, supplies the first document to the document exposure means and accommodates again the first document after the exposure of the first document, and the second document supply means accommodates plural sheets of the second document, supplies the second document sheet by sheet to the document exposure means and discharges the second document after the exposure of the second document.

14. A copying apparatus according to claim 13, wherein the image forming means realizes copying of the first document and the second document to both surfaces of the same copy sheet.

15. A copying apparatus according to claim 13, wherein said image forming means realizes copying of the first document and the second document to the same surface of the same copy sheet.

16. A copying apparatus comprising;

a document exposure means for exposing a document, an exposure frequency input means for inputting a number of times of exposure to the document, a document supply means for accommodating a plurality of documents and for supplying documents sheet by sheet to the document exposure means, a document discharge means for discharging the document from the exposure means to a document receive portion after the input number of times of exposure have been completed, a document re-supply means for once accommodating the document exposed by the exposure means in such a frequency as being input, supplying the document again to the document exposure means in the predetermined timing, and accommodating again the document after the exposure to the document in such a frequency as being input, a first control means for controlling the document re-supply means in order to accommodate a document, which has been sent first to the document exposure means by the document supply means and completed the exposure in the input frequency, to the document re-supply means, a second control means for controlling the document discharge means in order to discharge a document, which has been sent second or successively to the document exposure means by the document supply means and has completed the exposure in the input frequency, to the document receive section, a third control means for operating the document re-supply means for each completion of exposure to the second or successive document in the input frequency, and a fourth control means for operating the document supply means for each completion of exposure in the input frequency to the document supplied to the document exposure means by the document supply means.

17. A copying apparatus comprising:

a document exposure means for exposing a document, an image forming means for forming an image of the exposed document on a copy sheet, a document supply means for accommodating a plurality of documents, supplying the document sheet by sheet to the document exposure means and discharging the document exposed from the document exposure means, a document re-supply means, separate from said document supply means, for reversing and sending again the discharged document is a double-side document mode, and for temporally once accommodating the discharged document, and then sending again the accommodated document to the document exposure means without reversing according to a predetermined timing in a special copying mode, a double-side mode selection means for selecting the double-side document mode, a special mode selection means for selecting the special mode, and a means for releasing the double-side document mode in response to the selection of special mode by the special mode selection means.

18. A copying apparatus comprising;

a document exposure means for exposing a document, an image forming means for executing single copying operation on the same copy sheet in a first copying mode and for executing several copying operations on the same copy sheet in a second copying mode, a document supply means for accommodating a plurality of documents, supplying the documents sheet by sheet to the document exposure means and discharging the documents exposed from the document exposure means, a document re-supply means, separated from said document supply means, for reversing upside down the document discharged from the document exposure means and sending the document again to the document exposure means in a first transportation mode and for temporally accommodating the document discharged from the document exposure means and then sending again the accommodated document to the document exposure means without reversing according to a predetermined timing in a second transportation mode, a transportation mode selection means for selectively setting the first transportation mode and the second transportation mode, and means for selecting the second copying mode responding to selection of the second transportation mode by the transportation mode selection means.

19. A copying apparatus accoring to claim 18, wherein the second copying mode realizes copying operations in several times to the same surface of the copy sheet.

20. A copying apparatus according to claim 18, wherein the second copying mode realizes copying operation to both sides of the copy sheet.

* * * * *